US012252829B2

(12) United States Patent
Jung et al.

(10) Patent No.: US 12,252,829 B2
(45) Date of Patent: Mar. 18, 2025

(54) LAUNDRY TREATING APPARATUS

(71) Applicant: LG Electronics Inc., Seoul (KR)

(72) Inventors: Youngho Jung, Seoul (KR); Donghyun Jin, Seoul (KR); Daehan Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/388,986

(22) Filed: Nov. 13, 2023

(65) Prior Publication Data

US 2024/0076819 A1 Mar. 7, 2024

Related U.S. Application Data

(63) Continuation of application No. 17/859,716, filed on Jul. 7, 2022, now Pat. No. 11,859,326, which is a (Continued)

(30) Foreign Application Priority Data

Feb. 19, 2020 (KR) ..... 10-2020-0020459

(51) Int. Cl.

| | |
|---|---|
| ***D06F 29/00*** | (2006.01) |
| ***D06F 34/34*** | (2020.01) |
| ***D06F 35/00*** | (2006.01) |
| ***D06F 39/08*** | (2006.01) |
| *D06F 25/00* | (2006.01) |

(52) U.S. Cl.

CPC ..... *D06F 29/005* (2013.01); *D06F 34/34* (2020.02); *D06F 35/005* (2013.01); *D06F 39/083* (2013.01); *D06F 25/00* (2013.01)

(58) Field of Classification Search

CPC ..... D06F 29/005

See application file for complete search history.

(56) References Cited

U.S. PATENT DOCUMENTS

2006/0081015 A1 4/2006 Rizzetto et al.

FOREIGN PATENT DOCUMENTS

| | | |
|---|---|---|
| CN | 101346508 | 1/2009 |
| CN | 203190527 | 9/2013 |

(Continued)

OTHER PUBLICATIONS

Extended European Search Report in European Appln. No. 21157841.4, dated Jun. 28, 2021, 11 pages.

(Continued)

*Primary Examiner* — Jason Y Ko

(74) *Attorney, Agent, or Firm* — Fish & Richardson P.C.

(57) ABSTRACT

A laundry treating apparatus is disclosed. The laundry treating apparatus includes a first treating apparatus having a first front panel disposed on a front face thereof, a second treating apparatus disposed beneath the first treating apparatus to support the first treating apparatus, wherein the second treating apparatus has a second front panel disposed on a front face thereof, and a control panel disposed between the first front panel and the second front panel, wherein the control panel is signally connected to the first treating apparatus and the second treating apparatus, wherein the control panel has a top face facing toward the first front panel. A drain passage extending along a lateral direction is defined in the top face, so that water delivered to the top face flows in the lateral direction along the drain passage and is drained.

18 Claims, 24 Drawing Sheets

Related U.S. Application Data continuation of application No. 17/179,712, filed on Feb. 19, 2021, now Pat. No. 11,434,593.

(56) References Cited

FOREIGN PATENT DOCUMENTS

| | | |
|---|---|---|
| CN | 207243192 | 4/2018 |
| CN | 207544706 | 6/2018 |
| CN | 108239844 | 7/2018 |
| CN | 209863730 | 12/2019 |
| CN | 110685124 | 1/2020 |
| EP | 3521501 | 8/2019 |
| JP | 2006-110352 | 4/2006 |
| JP | 2019-166341 | 10/2019 |
| KR | 100652459 | 12/2006 |
| KR | 10-2007-0067464 | 6/2007 |
| KR | 10-2008-0021921 | 3/2008 |

OTHER PUBLICATIONS

Office Action in Chinese Appln. No. 202110192136.7, dated Oct. 28, 2022, 14 pages (with English translation).

LAUNDRY TREATING APPARATUS

CROSS-REFERENCE TO RELATED APPLICATION

This application is a continuation of U.S. application Ser. No. 17/859,716, filed on Jul. 7, 2022, which is a continuation of U.S. application Ser. No. 17/179,712, filed on Feb. 19, 2021, now U.S. Pat. No. 11,434,593, which claims the benefit of Korean Patent Application No. 10-2020-0020459, filed on Feb. 19, 2020. The disclosures of the prior applications are incorporated by reference in their entirety.

TECHNICAL FIELD

The present disclosure relates to a laundry treating apparatus, and relates to a laundry treating apparatus including a first treating apparatus on an upper side and a second treating apparatus on a lower side.

BACKGROUND

A laundry treating apparatus is an apparatus that puts laundry such as clothes, bedding, and the like into a drum to perform treatment necessary for the laundry, such as to remove contamination from the laundry or to dry the laundry.

When the laundry treating apparatus is designed to remove the contamination from the laundry, the laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a cabinet forming an appearance of the laundry treating apparatus, a tub accommodated in the cabinet, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

The detergent feeder has a detergent feeding function to improve a washing effect. Herein, the detergent means a substance, such as fabric detergent, fabric softener, fabric bleach, and the like, that enhances the washing effect. Detergent in a powder form and detergent in a liquid form may be used as the detergent.

In one example, when the laundry treating apparatus is designed to dry the laundry, the laundry treating apparatus may remove moisture from the laundry by supplying dry air to the laundry.

The laundry treating apparatus may include a cabinet, a drum rotatably disposed inside the cabinet, heating means for heating or drying the air supplied to the laundry, and the like.

As the dry air is supplied to the laundry accommodated in the drum, the moisture present in the laundry may be evaporated and removed by the dry air, and water may be removed from the laundry.

In one example, a laundry treating apparatus is equipped with a plurality of treating apparatuses. The laundry treating apparatus includes a first treating apparatus on an upper side and a second treating apparatus on a lower side. In addition, a structure in which each of the first treating apparatus and the second treating apparatus has a manipulation unit and a display is disclosed.

However, the laundry treating apparatus discloses the structure in which the plurality of treating apparatuses distinguished from each other have respective manipulation units and respective displays. In this case, a user must respectively identify states of the respective plurality of treating apparatuses, and must respectively manipulate the plurality of treating apparatuses. In addition, it may be disadvantageous for the user to operate the plurality of treating apparatuses in conjunction with each other.

Further, the plurality of treating apparatus may contain water used or generated in the process of processing the laundry. In addition, there is a possibility that the water may flow down or invade the manipulation unit and the display arranged on each of the plurality of treating apparatuses and controlling each of the plurality of treating apparatuses. In this case, serious damage may occur to the manipulation unit or the display, which may include an electronic controller.

Therefore, in the laundry treating apparatus equipped with the plurality of treating apparatuses, it is an important task to improve convenience of the user in identifying or manipulating operation states of the plurality of treating apparatuses, to effectively prevent damage to a device caused by the water or the like that may exist in each treating apparatus, and to present an effective arrangement relationship and a stable and effective coupling relationship between the components for the plurality of treating apparatuses.

SUMMARY

Embodiments of the present disclosure are intended to provide a laundry treating apparatus including an efficient arrangement and coupling structure of a control panel for simultaneously identifying or controlling a plurality of treating apparatuses for treating laundry.

In addition, embodiments of the present disclosure are intended to provide a laundry treating apparatus that may effectively prevent damage to a control panel caused by water or the like that may be generated by the laundry treating apparatus.

In addition, embodiments of the present disclosure are intended to provide a laundry treating apparatus that effectively improves coupling stability between components and has excellent space utilization.

A laundry treating apparatus according to an embodiment of the present disclosure may define a drain passage in a top face of a control panel that is connected to both of a first treating apparatus and a second treating apparatus, thereby effectively securing safety of the control panel even in a situation in which water falls onto the control panel.

Specifically, the laundry treating apparatus according to an embodiment of the present disclosure may include a plurality of treating apparatuses. The first treating apparatus may dry laundry, and the second treating apparatus may wash the laundry.

The first treating apparatus and the second treating apparatus may have a structure stacked together in a vertical direction. That is, the first treating apparatus may be disposed on the second treating apparatus.

Each of the first treating apparatus and the second treating apparatus has a laundry inlet into which the laundry is inserted defined at a front face thereof, and each drum for accommodating therein the laundry inserted into each cabinet through each laundry inlet may be in a front loader form whose rotation axis direction is parallel to a front and rear direction.

A control panel that is signally connected to the first treating apparatus and the second treating apparatus may be disposed between the first treating apparatus and the second treating apparatus. The control panel may form a portion of a front face of the laundry treating apparatus. For example, the control panel may be disposed between a first front panel of the first treating apparatus and a second front panel of the second treating apparatus, so that a front face of the control panel may be exposed forward.

An embodiment of the present disclosure may control the first treating apparatus and the second treating apparatus through one control panel. The control panel may include a display for displaying operating states of the first treating apparatus and the second treating apparatus, and a manipulation unit for a user to control the first treating apparatus and the second treating apparatus.

A top face of the control panel is located beneath a first front panel of the first treating apparatus, and a drain passage extending in a lateral direction is defined, so that water existing on the top face does not flow down to a front face or a rear face of the control panel, but flows to both sides and is drained.

An opening may be defined in the top face of the control panel, and the opening may be surrounded by an inflow prevention rib that prevents the water from flowing into the opening, thereby effectively preventing the water that has fallen onto the top face from flowing into the opening.

Particular implementations of the present disclosure provide a laundry treating system that includes first and second treating apparatuses and a control panel. The first treating apparatus has a first front panel and a first drum disposed inside the first treating apparatus that is configured to accommodate a first laundry therein. The second treating apparatus is disposed beneath the first treating apparatus and supports the first treating apparatus. The second treating apparatus has a second front panel and a second drum disposed inside the second treating apparatus that is configured to accommodate a second laundry therein. The control panel is disposed between the first front panel and the second front panel. The control panel is configured to communicate with the first treating apparatus and the second treating apparatus. The control panel has a top face facing the first front panel and defining a drain passage that extends along a first direction at the top face to thereby allow water delivered to the top face to flow in the first direction along the drain passage and be drained from the top face.

In some implementations, the system can optionally include one or more of the following features. The control panel may have a front face connected to the top face. An upper end of the front face may protrude upward from the top face. The top face may include a passage rib protruding upward and extending in the first direction. The passage rib may be disposed at a rear end of the top face. The drain passage may be defined by the upper end of the front face and the passage rib of the top face. The control panel may have side faces. Upper ends of the side faces may protrude upward from the top face. Lateral ends of the passage rib may be respectively spaced apart from the side faces of the control panel to thereby define a drainage between each of the upper ends of the side faces of the control panel and each of the lateral ends of the passage rib. The drainage may be in fluid communication with the drain passage. The top face of the control panel may include at least one panel supporting portion located at the drain passage. The at least one panel supporting portion may protrude upward and supports a bottom of the first front panel. The top face of the control panel may include at least one panel fastening portion located at the drain passage. The at least one panel fastening portion may protrude upward and be inserted into the bottom of the first front panel. A protruding height of the at least one panel fastening portion may be greater than a protruding height of the at least one panel supporting portion. The first front panel may include a lower end bending portion extending rearward from a lower end of the first front panel. The at least one panel supporting portion of the control panel may support the lower end bending portion of the first front panel. The at least one panel fastening portion of the control panel may penetrate the lower end bending portion of the first front panel. The at least one panel supporting portion may include a plurality of panel supporting portions. The at least one panel fastening portion may include a plurality of panel fastening portions. The plurality of panel supporting portions and the plurality of panel fastening portions may be alternately arranged with each other along the first direction. The top face of the control panel may define an opening in a vertical direction. The top face of the control panel may include a fastening elastic portion that extends from an inner face of the opening and intersects with the opening. The at least one panel fastening portion of the control panel may be disposed at the fastening elastic portion of the control panel. The top face of the control panel may include an inflow prevention rib extending around the opening and protruding upward from the top face of the control panel. The inflow prevention rib may be configured to block the water in the drain passage from flowing into the opening. The first treating apparatus may include a lower frame being coupled to the control panel behind the control panel and fixing the control panel. The lower frame of the first treating apparatus may include a main frame face extending along the first direction. The main frame face may be disposed behind the control panel and define an interior of the first treating apparatus from the control panel. The lower frame of the first treating apparatus may include an upper end extension extending frontward from an upper end of the main frame face, and a top coupling portion protruding upward from the upper end extension and coupled to the bottom of the first front panel. The top face of the control panel may be inserted between the upper end extension and the first front panel. The top face of the control panel may include a coupling portion receiving groove being opened rearward. The top coupling portion may be inserted rearwardly into the coupling portion receiving groove. A portion of the passage rib of the control panel may extend along the coupling portion receiving groove to thereby restrict the water from flowing into the coupling portion receiving groove. The first direction may be a direction along which the control panel extends between opposite sides of the laundry treating system. The first treating apparatus and the second treating apparatus may have a same horizontal width. The first treating apparatus may include opposing first side panels, and the second treating apparatus may include opposing second side panels that are flush with the first side panels.

In an aspect of the present disclosure, a laundry treating apparatus includes a first treating apparatus having a first front panel disposed on a front face thereof and a first drum disposed therein for accommodating laundry therein, a second treating apparatus disposed beneath the first treating apparatus to support the first treating apparatus, wherein the second treating apparatus has a second front panel disposed on a front face thereof and a second drum disposed therein for accommodating the laundry therein, and a control panel disposed between the first front panel and the second front panel, wherein the control panel is signally connected to the first treating apparatus and the second treating apparatus.

In one implementation, the control panel may have a top face facing toward the first front panel, and a drain passage extending along a lateral direction may be defined in the top face, so that water delivered to the top face may flow in the lateral direction along the drain passage and be drained.

In one implementation, the control panel may have a front face connected to the top face, an upper end of the front face may protrude upwards from the top face, the top face may include a passage rib protruding upward and extending in the lateral direction disposed at a rear end thereof, and the drain passage may be defined by the upper end of the front face and the passage rib.

In one implementation, the control panel may have side faces respectively disposed on both sides in the lateral direction, upper ends of the respective side faces may protrude upwards from the top face, and both ends in the lateral direction of the passage rib may be respectively spaced apart from the side faces respectively facing thereto, so that each drainage in communication with the drain passage may be defined between the upper end of each side face and the passage rib.

In one implementation, the top face may include a panel supporting portion located within the drain passage, wherein the panel supporting portion protrudes upwards to support a bottom of the first front panel.

In one implementation, the top face may further include a panel fastening portion located within the drain passage, wherein the panel fastening portion protrudes upwards to be inserted into the bottom of the first front panel.

In one implementation, a protruding height of the panel fastening portion may be larger than a protruding height of the panel supporting portion.

In one implementation, the first front panel may include a lower end bending portion extending rearward from a lower end of the first front panel, the panel supporting portion may support the lower end bending portion, and the panel fastening portion may penetrate the lower end bending portion.

In one implementation, the panel supporting portion and the panel fastening portion may respectively include a plurality of panel supporting portions and a plurality of panel fastening portions, and the panel supporting portion and the panel fastening portion may be alternately arranged with each other along the lateral direction in a repeated manner.

In one implementation, the top face may include an opening opened in a vertical direction and a fastening elastic portion extending from an inner face of the opening to intersect the opening, and the panel fastening portion may be disposed on the fastening elastic portion.

In one implementation, the top face may further include an inflow prevention rib extending to surround the opening and protruding upward to block the water in the drain passage from flowing into the opening.

In one implementation, the first treating apparatus may further include a lower frame coupled to the control panel at the rear of the control panel to fix the control panel.

In one implementation, the lower frame may include a main frame face extending along the lateral direction, wherein the main frame face divides an interior of the first treating apparatus from the control panel.

In one implementation, the lower frame may further include an upper end extension extending frontward from an upper end of the main frame face, and a top coupling portion protruding upward from the upper end extension and coupled to the bottom of the first front panel.

In one implementation, the top face of the control panel may be inserted between the upper end extension and the first front panel, and the top face may include a coupling portion receiving groove opened rearward, wherein the top coupling portion is rearwardly inserted into the coupling portion receiving groove.

In one implementation, a portion of the passage rib may extend along the coupling portion receiving groove to prevent the water from flowing into the coupling portion receiving groove.

Embodiments of the present disclosure may provide the laundry treating apparatus including the efficient arrangement and coupling structure of the control panel for simultaneously identifying or controlling the plurality of treating apparatuses for treating the laundry.

In addition, embodiments of the present disclosure may provide the laundry treating apparatus that may effectively prevent the damage to the control panel caused by the water or the like that may be generated by the laundry treating apparatus.

In addition, embodiments of the present disclosure may provide the laundry treating apparatus that effectively improves the coupling stability between the components and has the excellent space utilization.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
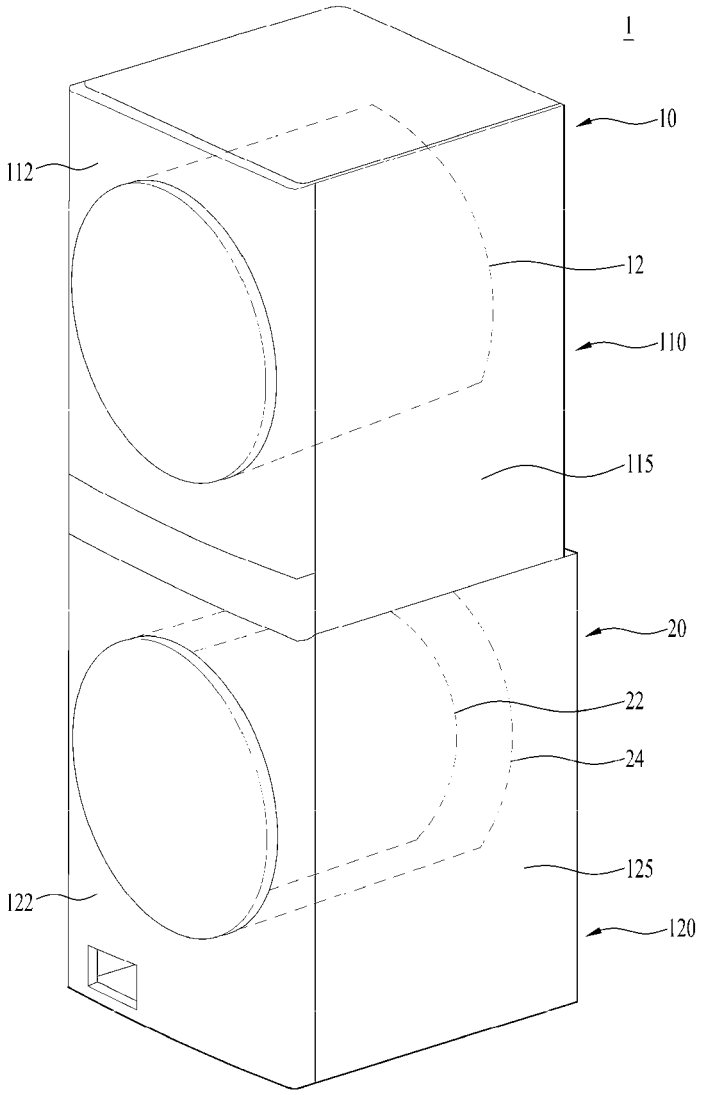
FIG. 1 is a perspective view showing a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', B', or 'both A and B'.

FIG. 1 shows a laundry treating apparatus 1 according to an embodiment of the present disclosure. In an embodiment of the present disclosure, the laundry treating apparatus 1 includes a first treating apparatus 10 and a second treating apparatus 20. The first treating apparatus 10 and the second treating apparatus 20 may be in various types for treating laundry, such as a washing machine for washing the laundry or a dryer for drying the laundry.

For example, the first treating apparatus 10 positioned on an upper side in FIG. 1, which is a dryer for drying the laundry, may have a first drum 12 disposed therein. The second treating apparatus 20 that is located on a lower side and supports the first treating apparatus 10 may correspond to the washing machine for washing the laundry, and may have a second drum 22 and a tub 24 arranged therein. When the second treating apparatus 20 corresponds to the laundry washing machine, the second drum 22 inside the second treating apparatus 20 may be rotatably disposed inside the tub 24.

However, in an embodiment of the present disclosure, the first treating apparatus 10 and the second treating apparatus 20 are not necessarily limited to the above types. When necessary, both the first treating apparatus 10 and the second treating apparatus 20 may be the washing machines or the dryers. In addition, the first treating apparatus 10 may be the washing machine, and the second treating apparatus 20 may be the dryer. The first treating apparatus 10 and the second treating apparatus 20 may be various apparatuses for treating the laundry.

The first treating apparatus 10 may include a first cabinet 110 forming an appearance thereof, and the first cabinet 110 may have a first front panel 112 on a front face thereof. A laundry inlet in communication with the first drum 12 may be defined in the first front panel 112, and the laundry inlet may be opened and closed by a cabinet door.

In addition, the first treating apparatus 10 may have each first side panel 115 on each of both faces thereof in a lateral direction Y, a first rear panel 118 on a rear face thereof, a first top panel on a top face thereof, and a first bottom panel 119 on a bottom face thereof.

The first front panel 112, the first side panels 115, the first rear panel 118, the first top panel, and the first bottom panel 119 may form the first cabinet 110 together, and have a coupling relationship with each other, and define a space in which internals constituting the first treating apparatus 10 such as the first drum 12 are arranged.

In the first treating apparatus 10, the laundry requiring the treatment and the like may be inserted into the first cabinet 110 through the laundry inlet and accommodated in the first drum 12, and a treating process by the first treating apparatus 10 such as washing, drying, and the like may be performed.

According to an embodiment of the present disclosure, FIG. 1 illustrates the first treating apparatus 10 in which the laundry inlet is defined in the first front panel 112 along with the cabinet door, and the first drum 12 has a rotation axis parallel to a front and rear direction X.

However, the laundry inlet may not be necessarily limited to being defined in the first front panel 112, and may be defined in the first side panel 115, the first top panel, or the like together with the cabinet door. For example, the first treating apparatus 10 may be a front loader type or a top loader type.

In one example, the second treating apparatus 20 may include a second cabinet 120 forming an appearance thereof, and the second cabinet 120 may have a second front panel 122 on a front face thereof. A laundry inlet in communication with the second drum 22 may be defined in the second front panel 122, and the laundry inlet may be opened and closed by a cabinet door.

In addition, the second treating apparatus 20 may have each second side panel 125 on each of both faces thereof in the lateral direction Y, a second rear panel 128 on a rear face thereof, a second top panel on a top face thereof, and a second bottom panel on a bottom face thereof.

The second front panel 122, the second side panels 125, the second rear panel 128, the second top panel, and the second bottom panel may form the second cabinet 120 together, and have a coupling relationship with each other, and define a space in which internals constituting the second treating apparatus 20 such as the second drum 22 and the tub 24 are arranged.

In the second treating apparatus 20, the laundry requiring the treatment and the like may be inserted into the second cabinet 120 through the laundry inlet and accommodated in the second drum 22, and a treating process by the second treating apparatus 20 such as the washing, the drying, and the like may be performed.

According to an embodiment of the present disclosure, FIG. 1 illustrates the second treating apparatus 20 in which the laundry inlet is defined in the second front panel 122 along with the cabinet door, and the second drum 22 has a rotation axis parallel to the front and rear direction X.

However, the laundry inlet may not be necessarily limited to being defined in the second front panel 122, and may be defined in the second side panel 125, the second top panel, or the like together with the cabinet door. For example, the first treating apparatus 10 may be the front loader type or the top loader type.

For example, the laundry inserted through the first front panel 112 may be accommodated in the first drum 12 to perform the washing, the drying or other treating processes, and the laundry inserted through the second front panel 122 may be accommodated in the second drum 22 to perform the washing, the drying, or other treating processes.

The first treating apparatus 10 may be disposed on the second treating apparatus 20, and thus, the second treating apparatus 20 may have a structure supporting the first treating apparatus 10 upward. For example, the second top panel of the second treating apparatus 20 may have a structure of directly or indirectly supporting the first bottom panel 119 of the first treating apparatus 10, and a bottom of the first treating apparatus 10 may be coupled with a top of the second treating apparatus 20.

In one example, in an embodiment of the present disclosure, a control panel 200 may be disposed between the first front panel 112 and the second front panel 122. The control panel 200 may be disposed between the first front panel 112 and the second front panel 122, and may be signally connected to at least one of the first treating apparatus 10 and the second treating apparatus 20.

The control panel 200 may have a front face 210, and side faces 240 on both sides in the lateral direction Y. The side face 240 may include a first side face 242 on one side in the lateral direction Y and a second side face 244 on the other side.

The control panel 200 may have a top face 220 and a bottom face 230. The front face 210, the side faces 240, the top face 220, and the bottom face 230 may be connected to each other. For example, the side faces 240, the top face 220, and the bottom face 230 may have a shape extending rearward from the front face 210.

The front face 210 of the control panel 200 may be exposed to the outside to form a front face of the laundry treating apparatus 1 according to an embodiment of the present disclosure together with the first front panel 112 and the second front panel 122. The side face 240 of the control panel 200 may be exposed to the outside in the lateral direction Y, and the top face 220 and the bottom face 230 thereof may be inserted between the first front panel 112 and the second front panel 122 and may not be exposed to the outside.

The control panel 200 may be signally connected to at least one of the first treating apparatus 10 and the second treating apparatus 20. The control panel 200 may include a display capable of indicating states of the first treating apparatus 10 and/or the second treating apparatus 20 disposed on the front face 210 thereof, and the first treating apparatus 10, and an input unit capable of inputting operation commands of the first treating apparatus 10 and/or the second treating apparatus 20.

Electric parts 224 may be arranged inside the control panel 200, that is, on a rear face of the front face 210. The electric parts 224 may be electrically connected to the first treating apparatus 10 and/or the second treating apparatus 20 and may exchange state information or control signals.

For example, the electric parts 224 may include a controller of the first treating apparatus 10 and a controller of the second treating apparatus 20, may include an integrated controller that controls the first treating apparatus 10 and the second treating apparatus 20 together, may include a panel controller connected to the controller of the first treating apparatus 10 and the controller of the second treating apparatus 20 in a control manner, or may be controlled by the controller of the first treating apparatus 10 and the controller of the second treating apparatus 20 without a separate controller.

The control panel 200 may include a rear face, but in an embodiment of the present disclosure, the rear face of the control panel 200 may be opened. The control panel 200 disposed between the first front panel 112 and the second front panel 122 may be positioned at a lower portion of the first treating apparatus 10 or at an upper portion of the second treating apparatus 20.

Figure 2:
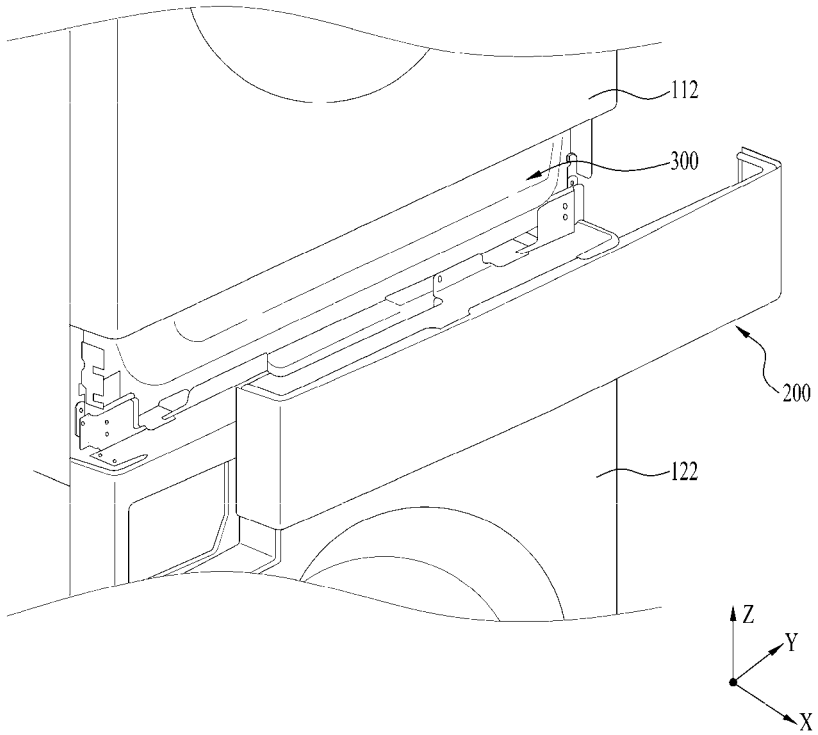
FIG. 2 is a view showing a state in which a control panel is separated from a laundry treating apparatus according to an embodiment of the present disclosure.
Figure 3:
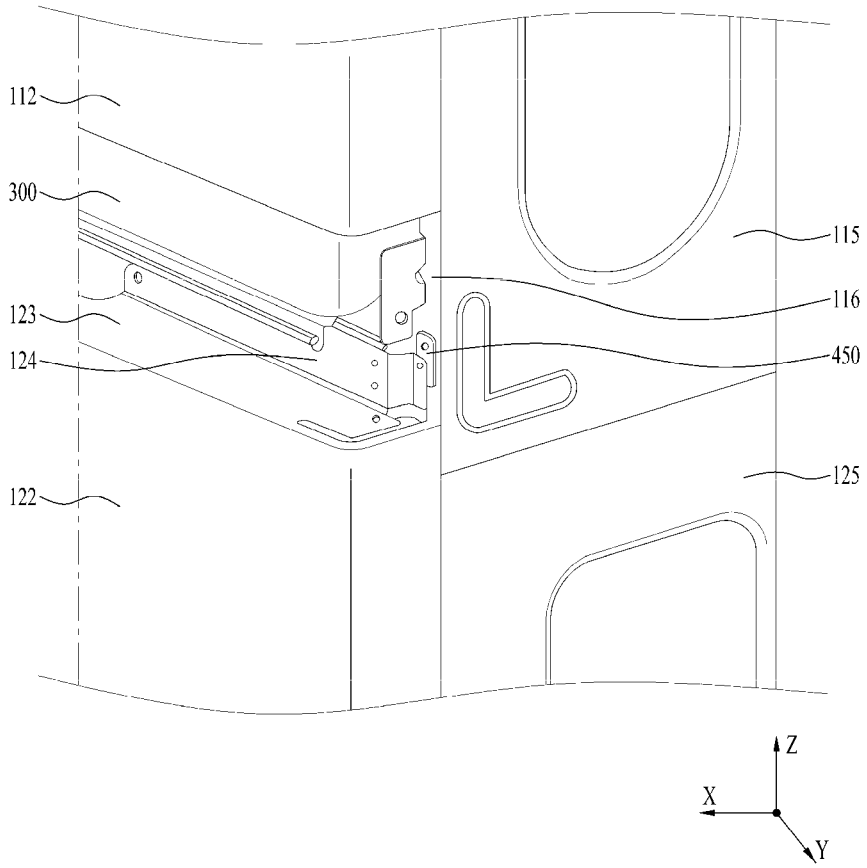
FIG. 3 is a view showing a coupled state of a lower frame in a laundry treating apparatus according to an embodiment of the present disclosure.
Figure 4:
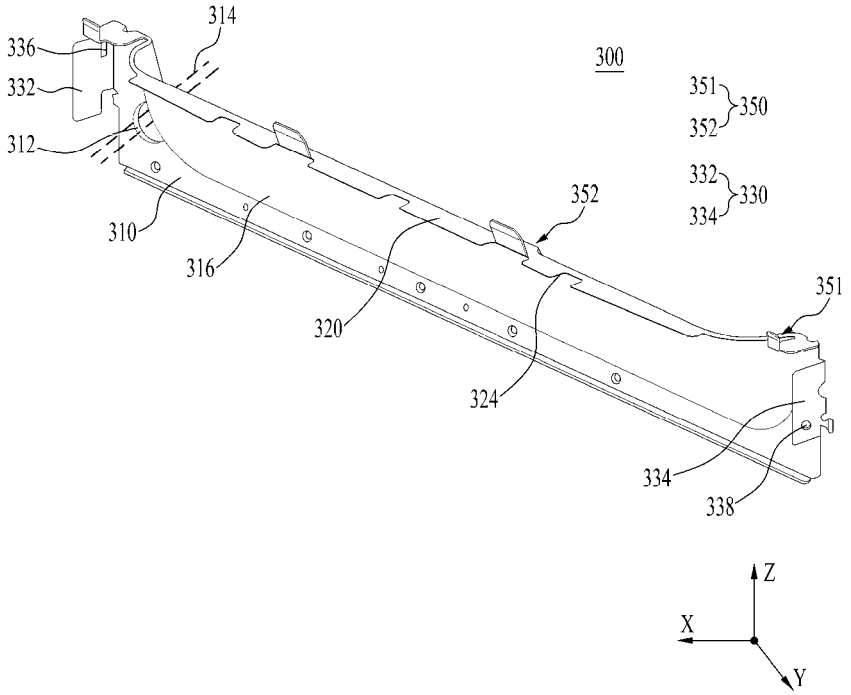
FIG. 4 is a perspective view showing a lower frame of a laundry treating apparatus according to an embodiment of the present disclosure.

In one example, FIG. 2 is a view showing a state in which the control panel 200 is separated from the laundry treating apparatus 1 according to an embodiment of the present disclosure, FIG. 3 shows a lower frame 300 coupled to a lower portion of the first treating apparatus 10 according to an embodiment of the present disclosure, and FIG. 4 shows a perspective view of the lower frame 300.

As shown in FIGS. 2 to 4, in an embodiment of the present disclosure, the first treating apparatus 10 may include the lower frame 300. The lower frame 300 may be coupled to the control panel 200 at the rear of the control panel 200 to fix the control panel 200.

The lower frame 300 may be constructed to be coupled to and fix the control panel 200 inserted between the first front panel 112 and the second front panel 122. The lower frame 300 may be disposed beneath the first front panel 112 and may be disposed at the rear of the control panel 200.

The lower frame 300 may be coupled with the control panel 200 while being fixed to the first treating apparatus 10. There may be various schemes of coupling with the control panel 200, and as will be described later, the side face 240 of the control panel 200 may be coupled with side end extensions 330 of the lower frame 300 to fix the control panel 200.

In an embodiment of the present disclosure, the first treating apparatus 10 and the second treating apparatus 20 are arranged together such that a user may perform an efficient laundry treating process, and one control panel 200 for efficient operation of the first treating apparatus 10 and the second treating apparatus 20 is disposed between the first front panel 112 and the second front panel 122 to improve ease of use.

In addition, as described above, the lower frame 300 disposed at the rear of the control panel 200 is disposed at the lower portion of the first treating apparatus 10 such that the control panel 200 disposed between the first front panel 112 and the second front panel 122 may be stably fixed and used. In addition, the lower frame 300 and the control panel 200 are coupled to each other, so that the control panel 200 may be effectively and stably coupled and fixed.

Referring to FIG. 3, in an embodiment of the present disclosure, both side faces in the lateral direction Y of the lower frame 300 may be respectively coupled to the first side panels 115 respectively facing toward the both side faces of the lower frame 300.

In the present disclosure, the components may have the front and rear directions X parallel to each other, the lateral directions Y parallel to each other, and the vertical directions Z. For example, the front and rear direction X of the first treating apparatus 10 may be defined identically to the front and rear directions X of the second treating apparatus 20, the control panel 200, the lower frame 300, and the like. In addition, the lateral directions Y and the vertical directions Z may also be defined as in the above scheme.

The both side faces in the lateral direction Y of the lower frame 300 may be respectively coupled to the first side panels 115. The lower frame 300 may be disposed at the lower portion of the front face of the first treating apparatus 10, and the both side faces in the lateral direction Y thereof may respectively face toward the first side panels 115 at the rear of the first side panels 115.

Each first side panel 115 may include a front end bending portion 116 extending from a front end thereof as will be described later, and the lower frame 300 may be coupled to the front end bending portions 116 of the first side panels 115. As for a coupling scheme, various schemes such as screw coupling, rivet coupling, fitting coupling, and the like may be used.

In an embodiment of the present disclosure, the lower frame 300 has the both side faces in the lateral direction Y respectively coupled to the first side panels 115, and the control panel 200 disposed at the front is coupled to the lower frame 300, so that the control panel 200 that may be connected with the first treating apparatus 10 and the second treating apparatus 20 between the first front panel 112 and the second front panel 122 may have the stable fixing structure.

In one example, referring to FIG. 4, in an embodiment of the present disclosure, the lower frame 300 may include a main frame face 310. The main frame face 310 extends along the lateral direction Y of the first treating apparatus 10 and may divide an interior of the first treating apparatus 10 from the control panel 200.

Specifically, the main frame face 310 of the lower frame 300 may be disposed in parallel with the front face 210 of the control panel 200. The main frame face 310 may extend in lateral direction Y, so that both ends thereof may be respectively coupled to the first side panels 115.

The main frame face 310 may be disposed between the interior of the first treating apparatus 10 and an interior of the control panel 200 to divide the interior of the first treating apparatus 10 from the interior of the control panel 200. Inside the first treating apparatus 10, various internals may be arranged, and there may be a large amount of water or a high-temperature air current as needed. In a process of using the first treating apparatus 10, unintended leak may occur, or the air current may affect the process.

Accordingly, an embodiment of the present disclosure may minimize influence of the water or a temperature change inside the first treating apparatus 10 on the control panel 200 as the lower frame 300 includes the main frame face 310 that divides the control panel 200 from the interior of the first treating apparatus 10.

The main frame face 310 may have various shapes as needed, and as described later, may include a convex portion 316 to secure a space in which the internals of the first treating apparatus 10 are arranged and effectively divide the control panel 200 from the interior of the first treating apparatus 10.

In one example, in an embodiment of the present disclosure, a connection hole 312 through which a signal connection line 314 for signally connecting the first treating apparatus 10 with the control panel 200 passes may be defined in the main frame face 310.

The above-described electric parts 224 may be arranged inside the control panel 200, and the electric parts 224 may be connected to a sensor, a motor, the controller of first treating apparatus 10, or the like disposed inside the first treating apparatus 10.

To this end, the signal connection line 314 may extend from the interior of the first treating apparatus 10 to the electric parts 224 of the control panel 200, and signal connection between components of the first treating apparatus 10 and the control panel 200 may be achieved by the signal connection line 314.

In one example, the control panel 200 may be fixed by the lower frame 300, and the lower frame 300 may include the main frame face 310 that divides the control panel 200 from the interior of the first treating apparatus 10, so that the connection hole 312 through which the signal connection line 314 may pass may be defined in the main frame face 310.

The signal connection line 314 may have various shapes. For example, the signal connection line 314 may include a connection jack or a connection port, and may be connected to the electric parts 224 through the connection hole 312.

Figure 5:
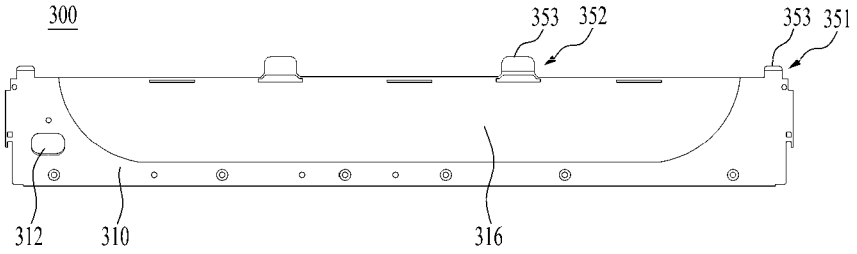
FIG. 5 is a front view showing a lower frame of a laundry treating apparatus according to an embodiment of the present disclosure.

There may also be various positions and shapes of the connection hole 312. FIG. 5 is a front view showing the lower frame 300 according to an embodiment of the present disclosure. Referring to FIG. 5, the connection hole 312 may be defined on one side in the lateral direction Y of the main frame face 310, and may be defined on a lower side of said one side such that the signal connection line 314 may be effectively connected to the electric parts 224.

Figure 6:
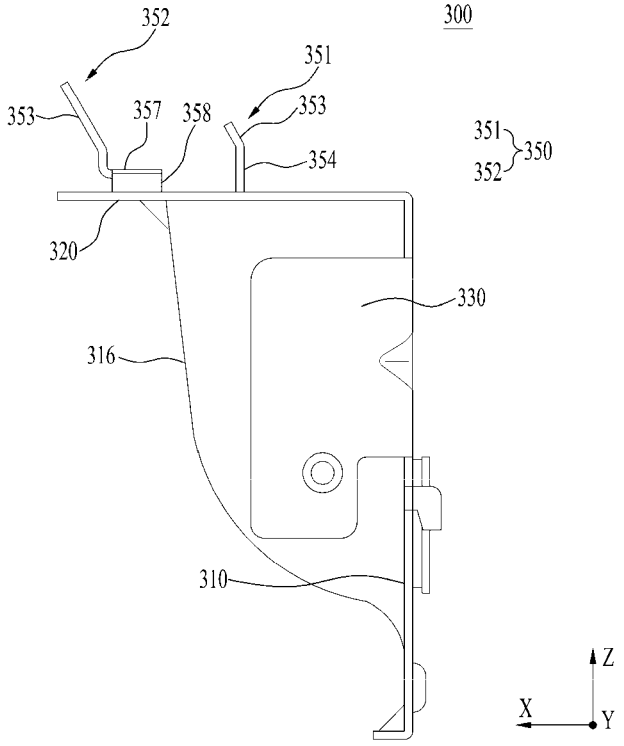
FIG. 6 is a side view showing a lower frame of a laundry treating apparatus according to an embodiment of the present disclosure.

In one example, FIG. 6 shows a side view of the lower frame 300 according to an embodiment of the present disclosure. Referring to FIGS. 4 to 6, in an embodiment of the present disclosure, the lower frame 300 may further include an upper end extension 320 and a top coupling portion 350.

The upper end extension 320 may extend forward from an upper end of the main frame face 310, and the top coupling portion 350 may protrude upward from the upper end extension 320 and be coupled to the bottom of the first front panel 112.

The upper end extension 320 may extend forward from the upper end of the main frame face 310 and may be positioned below the first front panel 112. The upper end extension 320 may extend along the lateral direction Y like the main frame face 310, and may extend forward from the main frame face 310.

The top coupling portion 350 may be disposed on the upper end extension 320. The top coupling portion 350 may protrude upward from the upper end extension 320 positioned below the first front panel 112 and may be coupled to the bottom of the first front panel 112.

There may be various numbers, positions, and shapes of the top coupling portion 350 or schemes of coupling with the first front panel 112 as needed. For example, in an embodiment of the present disclosure, the first front panel 112 may include a lower end bending portion 113, and the top coupling portion 350 may include a panel inserted portion 353 inserted into the lower end bending portion 113.

Specifically, the first front panel 112 may include the lower end bending portion 113 extending rearward from a lower end thereof. The lower end bending portion 113 may be bent at a lower end of a front face of the first front panel 112.

The lower end bending portion 113 may be disposed in parallel with the upper end extension 320, and the top coupling portion 350 may include a panel inserted portion 353 protruding toward the lower end bending portion 113 to penetrate the lower end bending portion 113.

The panel inserted portion 353 may penetrate the lower end bending portion 113 of the first front panel 112 and may be inserted into the bottom of the first front panel 112. The top coupling portion 350 may be coupled to the first front panel 112 as the panel inserted portion 353 penetrates and is inserted into the lower end bending portion 113.

In an embodiment of the present disclosure, the lower frame 300 is fixed by being coupled with each first side panel 115, fixes the control panel 200 by being coupled to the control panel 200 at the front, is coupled to the first front panel 112 through the upper end extension 320, and supports the first front panel 112, thereby effectively improving structural stability of the laundry treating apparatus 1 according to an embodiment of the present disclosure.

Figure 7:
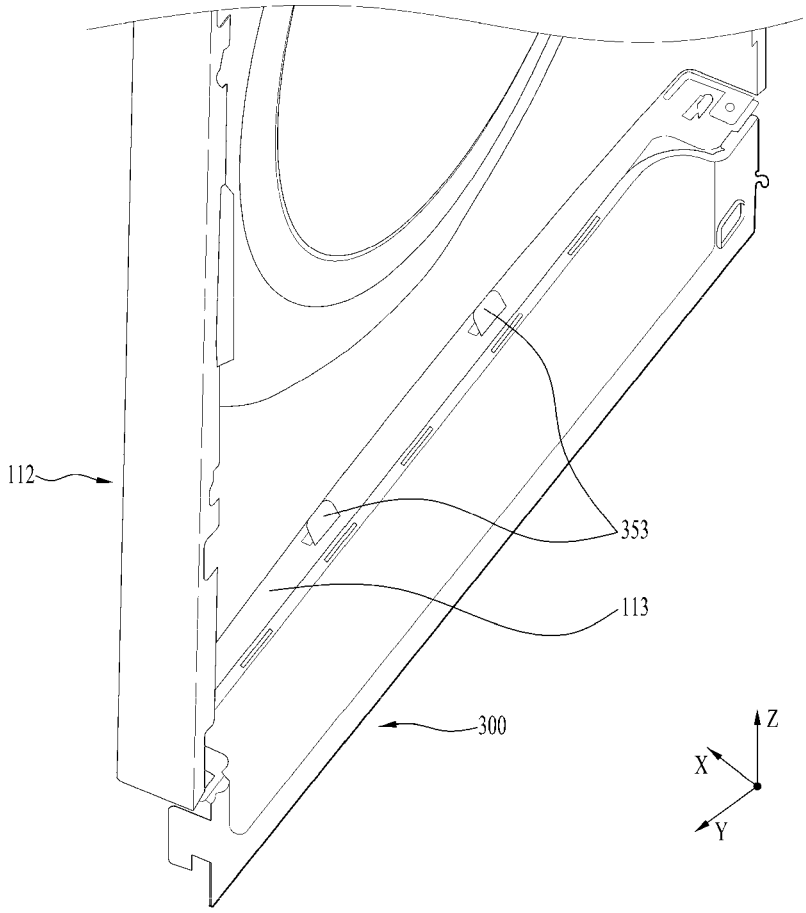
FIG. 7 is a view showing a coupling structure of a first front panel and a lower frame in a laundry treating apparatus according to an embodiment of the present disclosure.
Figure 8:
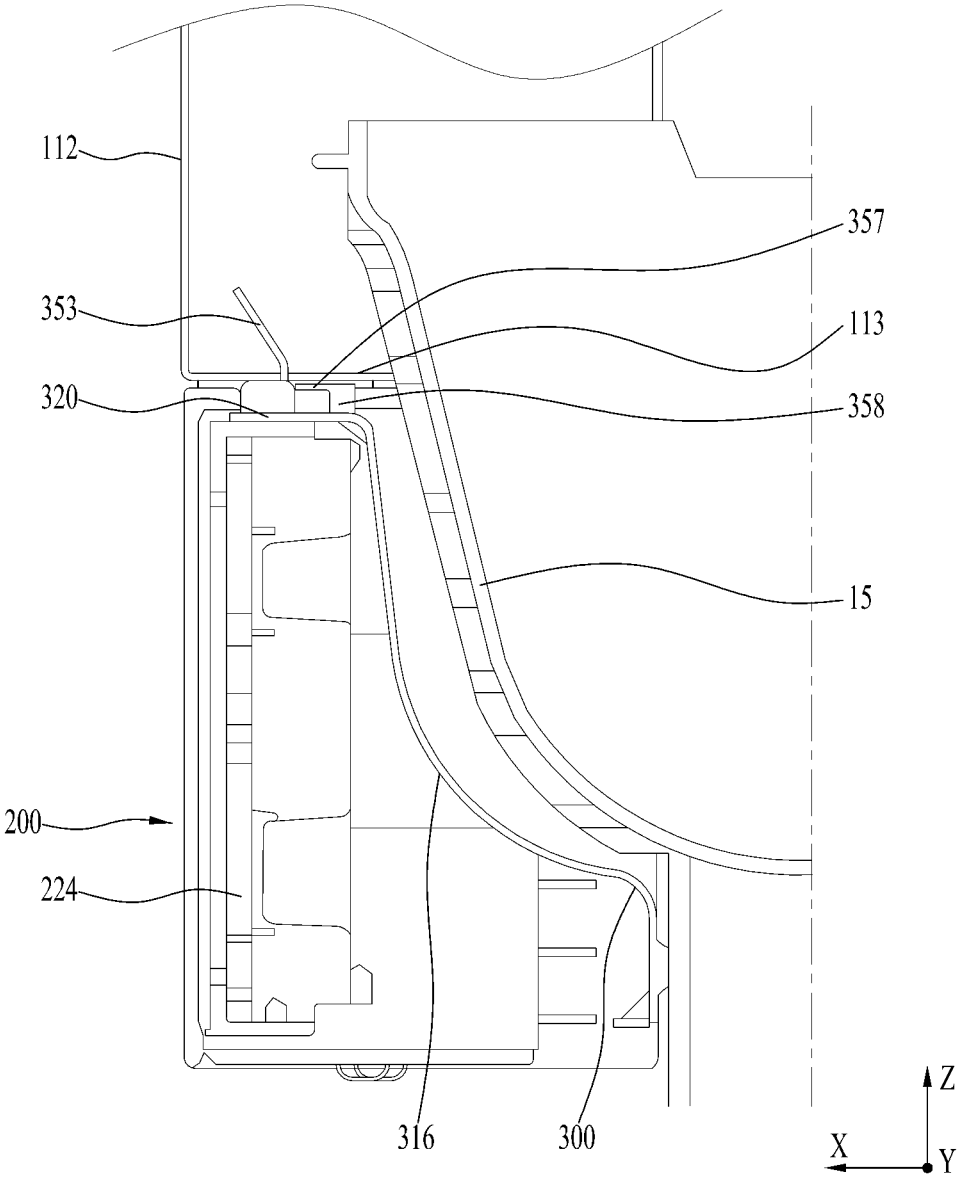
FIG. 8 is a cross-sectional view showing a state in which a lower frame and a control panel are coupled to each other in a laundry treating apparatus according to an embodiment of the present disclosure.

FIG. 7 shows a state in which the panel inserted portion 353 is inserted into the lower end bending portion 113 of the first front panel 112 according to an embodiment of the present disclosure, and FIG. 8 is a cross-sectional view showing a state in which the lower frame 300, the control panel, and the first front panel 112 are coupled to each other.

Referring to FIGS. 6 to 8, in an embodiment of the present disclosure, at least a portion of the panel inserted portion 353 may extend in an inclined manner such that an upper end thereof is positioned forwardly of a lower end thereof.

That is, the panel inserted portion 353 may be formed to be inclined forward upwardly. An inclined portion of the panel inserted portion 353 may be formed on an entirety of or only a portion of the panel inserted portion 353.

As the panel inserted portion 353 extends in the inclined manner, the upper end thereof is disposed close to the front face of the first treating apparatus 10. Accordingly, the lower end bending portion 113 of the first front panel 112 is moved rearward, so that the panel inserted portion 353 may be easily inserted, and fixation of the first front panel 112 into which the panel inserted portion 353 may be strengthened.

In one example, referring to FIGS. 6 and 8, in an embodiment of the present disclosure, the upper end extension 320 may be spaced downwardly apart from the first front panel 112, and the top coupling portion 350 may further include an ascending extension 354. The ascending extension 354 may extend from the upper end extension 320 toward the lower end bending portion 113. In addition, the panel inserted portion 353 may be disposed at an upper end of the ascending extension 354 to penetrate the lower end bending portion 113.

The first front panel 112, for example, the lower end bending portion 113 of the first front panel 112 and the upper end extension 320 may be spaced apart from each other. The top face 220 of the control panel 200 may be inserted between the upper end extension 320 and the first front panel 112.

The top coupling portion 350 may include the ascending extension 354 extending upward from the upper end extension 320, and the panel inserted portion 353 extending from the ascending extension 354 may be inserted into the first front panel 112.

The top fastening portion may include a first top fastening portion and a second top fastening portion. The ascending extension 354 may be included in the first top fastening portion. That is, in the first top fastening portion, the ascending extension 354 extending from the upper end extension 320 may extend to the lower end bending portion 113 of the first front panel 112, and the panel inserted portion 353 may be disposed on the upper end of the ascending extension 354 and be inserted into the first front panel 112 through the lower end bending portion 113.

There may be various shapes or extension directions of the ascending extension 354, and FIG. 4 shows the plate-shaped panel inserted portion 353 extending in an inclined manner forward from the upper end of the plate-shaped ascending extension 354 according to an embodiment of the present disclosure.

In one example, in an embodiment of the present disclosure, the top coupling portion 350 may include a top support 356, and the panel inserted portion 353 may be disposed on the top support 356. For example, in an embodiment of the present disclosure, the top coupling portion 350 may include a second top coupling portion 352, the second top coupling portion 352 may include the top support 356, and the panel inserted portion 353 may be disposed on the top support 356.

Specifically, the top support 356 may be disposed on the upper end extension 320 and support the lower end bending portion 113. That is, the top support 356 may be constructed such that an upper end thereof is in contact with the lower end bending portion 113 and supports the lower end bending portion 113 upward.

The top support 356 may have a face for supporting the lower end bending portion 113 or may be formed in a protrusion shape to be in contact with the lower end bending portion 113.

When the top support 356 is disposed on the top coupling portion 350, for example, in a case of the second top coupling portion 352 including the top support 356, the panel inserted portion 353 may be disposed on the top support 356 to penetrate the lower end bending portion 113.

That is, the second top coupling portion 352 may be disposed such that the top support 356 is in contact with the lower end bending portion 113 on the upper end extension 320, and the panel inserted portion 353 may be disposed to protrude upward from the top support 356 to penetrate the lower end bending portion 113.

As above, in an embodiment of the present disclosure, the top coupling portion 350 is constructed to include the top support 356 supporting the lower end bending portion 113, so that the bottom of the first front panel 112 may be supported upward by the lower frame 300 and may be structurally stabilized.

In one example, as shown in FIG. 6, the top support 356 may include a top support face 357 that is spaced upwardly from the upper end extension 320, and is disposed to be in parallel with the lower end bending portion 113 and supports the lower end bending portion 113, and the panel inserted portion 353 may extend from the top support face 357.

The top support face 357 may be disposed to be in parallel with the lower end bending portion 113, and may be disposed to be in parallel with the upper end extension 320. That is, the top support face 357 may be in a form offset upward from the upper end extension 320.

The top support face 357 may be preferably in a face-contact with a bottom face of the lower end bending portion 113 to support the first front panel 112.

In addition, in an embodiment of the present disclosure, the top support 356 may further include a top connection portion 358 connecting the top support face 357 and the upper end extension 320 with each other, and the panel inserted portion 353 may be disposed on a front end of the top support face 357 and at least partially extend in an inclined manner such that an upper end thereof is positioned forward of a lower end thereof.

The top support face 357 may be formed in a plate shape and may be disposed in parallel with the lower end bending portion 113, and may have a connection relationship with the upper end extension 320 by the top connection portion 358. That is, in the top support 356, the top support face 357 may be connected to the upper end extension 320 by the top connection portion 358.

The top connection portion 358 may be formed in various shapes. FIGS. 5 to 6 show that the top connection portion 358 is formed in a substantially plate shape according to an embodiment of the present disclosure and extends from one edge of the top support face 357 toward the upper end extension 320.

In one example, in a case of the second top coupling portion 352 having the top support 356, the panel inserted portion 353 may extend upward from the front end, that is, a front edge, of the top support face 357. Accordingly, the first front panel 112 may be supported on the top support face 357 while being moved rearward on the top of the lower frame 300, and the panel inserted portion 353 may penetrate and be coupled to the lower end bending portion 113.

In addition, the top connection portion 358 may be formed at both side edges and a rear edge of the top support face 357 to stably fix the top support face 357 to the upper end extension 320.

In an embodiment of the present disclosure, the top coupling portion 350 includes a first top coupling portion 351 having the ascending extension 354 and coupled to the first front panel 112, and a second top coupling portion 352 that supports and fixes the first front panel 112, so that a coupling strength and a support strength between the first front panel 112 and the lower frame 300 may be efficiently determined. The numbers and positions of the first top coupling portion 351 and the second top coupling portion 352 may be variously determined as needed.

FIG. 4 shows that each first top coupling portions 351 is disposed on each of both sides in the lateral direction Y of the upper end extension 320, and second top coupling portions 352 are arranged at a center of the upper end extension 320 according to an embodiment of the present disclosure.

Figure 9:
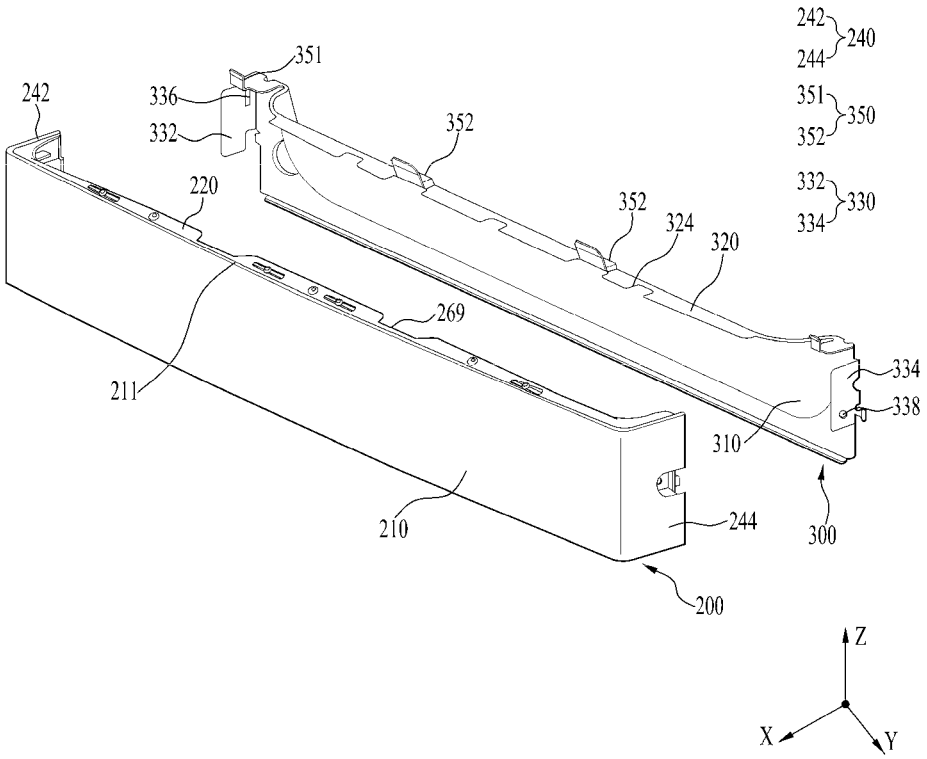
FIG. 9 is a view showing a control panel and a lower frame in a laundry treating apparatus according to an embodiment of the present disclosure.
Figure 10:
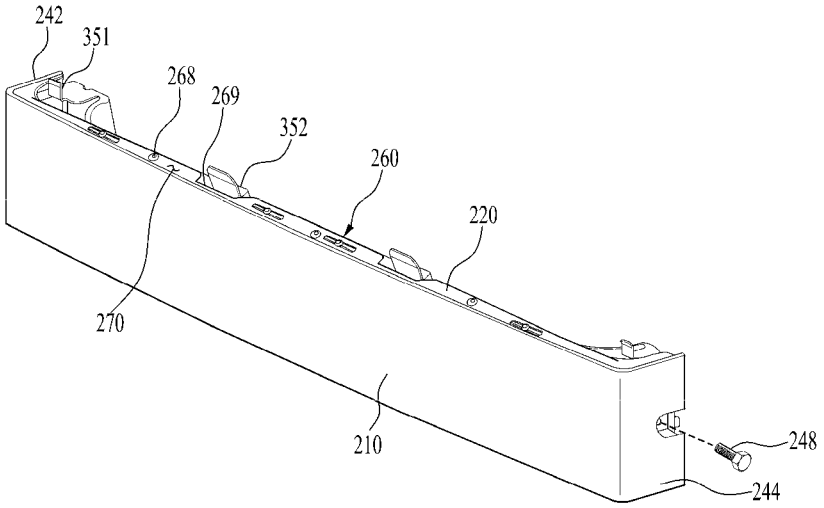
FIG. 10 is a view showing a control panel coupled to a lower frame in a laundry treating apparatus according to an embodiment of the present disclosure.

In one example, FIG. 9 shows a state of the control panel 200 separated from the lower frame 300 forward, and FIG. 10 shows a state in which the lower frame 300 and the control panel 200 of FIG. 9 are coupled to each other.

Referring to FIGS. 9 and 10, in the laundry treating apparatus 1 according to an embodiment of the present disclosure, the lower frame 300 may include the side end extensions 330, and the side end extensions 330 may respectively extend forward from both sides of the lower frame 300 to be coupled to the control panel 200.

As described above, the lower frame 300 has the main frame face 310 that divides the control panel 200 from the interior of the first treating apparatus 10, and may include the upper end extension 320 to support and fix the bottom of the first front panel 112.

Furthermore, an embodiment of the present disclosure includes the side end extensions 330 respectively extending forward from both sides in the lateral direction Y of the main frame face 310, so that the lower frame 300 may be coupled with the first front panel 112 upward, and at the same time, may be coupled with the control panel 200 in the front through the side end extensions 330, thereby enabling efficient space utilization and realizing a coupling structure.

The side end extension 330 may include a first side end extension 332 disposed on one side in the lateral direction Y of the lower frame 300 and a second side end extension 334 disposed on the other side in the lateral direction Y of the lower frame 300.

In addition, the first side end extension 332 may include a hook inserting portion 336 into which a side face hook 246 disposed on the control panel 200 is inserted, and the second side end extension 334 may include a through hole 338 coupled with a penetrating member 248 penetrating the control panel 200.

Figure 11:
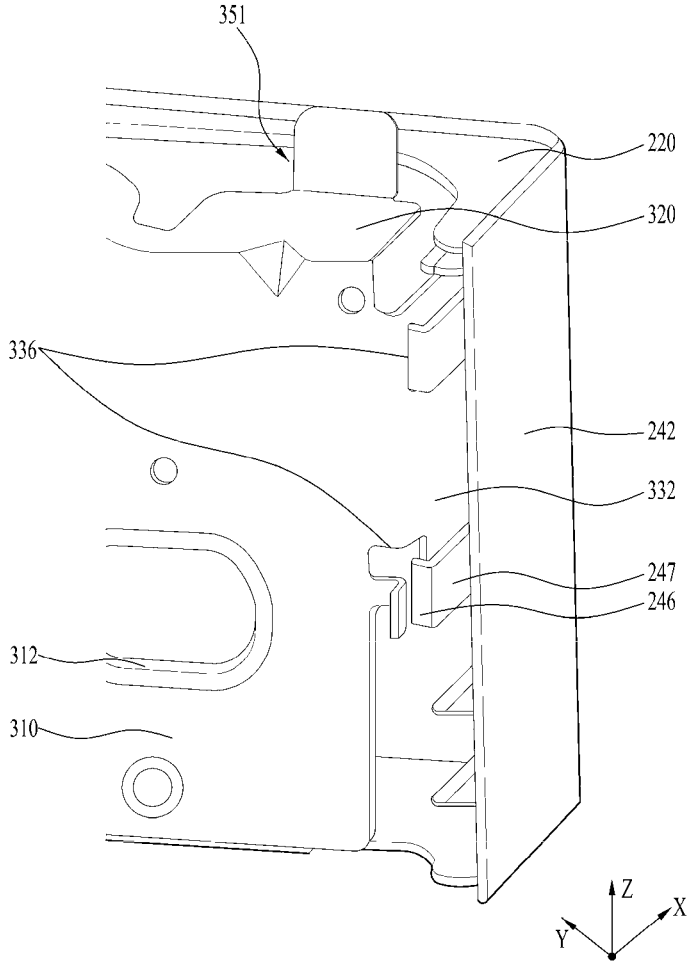
FIG. 11 is a view showing a side face hook of a control panel in a laundry treating apparatus according to an embodiment of the present disclosure.

FIG. 9 shows the second side end extension 334 including the through hole 338 to which the penetrating member 248 is coupled, and FIG. 11 is a view of the first side end extension 332 including the hook inserting portion 336 viewed from the rear.

The first side end extension 332 includes the hook inserting portion 336 into which the side face hook 246 disposed on the control panel 200 is inserted. The control panel 200 may include a first side face 242 on one side in the lateral direction Y, and may include the side face hook 246 disposed inside the first side face 242.

Specifically, the first side end extension 332 may be disposed on one side in the lateral direction Y of the main frame face 310 to face toward an inner face of the first side face 242, and the side face hook 246 may be disposed between the first side face 242 and the first side end extension 332.

The side face hook 246 may protrude toward the first side end extension 332 and be inserted into the hook inserting portion 336 of the first side end extension 332, so that the control panel 200 may be fixed to the lower frame 300.

The side face hook 246 may protrude from one side in the lateral direction Y of the control panel 200 toward the other side and may be inserted into the first side end extension 332 of the lower frame 300.

Figure 13:
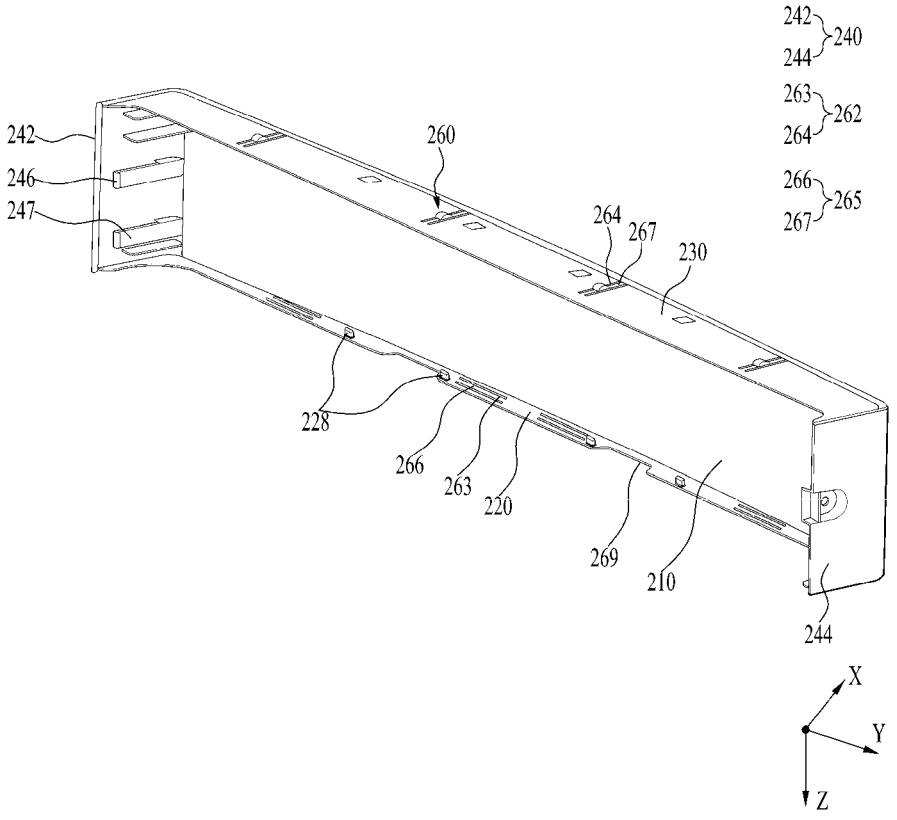
FIG. 13 is a perspective view of a control panel of a laundry treating apparatus according to an embodiment of the present disclosure viewed from the rear.

In one example, in an embodiment of the present disclosure, the control panel 200 may further include a hook extension 247. FIG. 13 shows the hook extension 247 and the side face hook 246 arranged on an inner face of the first side face 242 of the control panel 200.

The hook extension 247 may extend rearward from the front face 210, may be located between the first side face 242 and the first side end extension 332, may be spaced apart from the first side face 242, and may have the side face hook 246 at an extended end thereof.

The hook extension 247 may extend rearward from the rear face of the front face 210 of the control panel 200, and may be spaced apart from the inner face of the first side face 242, that is, one face of the first side face 242 facing toward the other side in the lateral direction Y of the control panel 200.

As the side face hook 246 and the hook extension 247 are arranged between the first side face 242 of the control panel 200 and the first side end extension 332 of the lower frame 300, and as the side face hook 246 is disposed on an end of the hook extension 247 spaced apart from the first side face 242, in an insertion process of the control panel 200, the hook extension 247 may be bent and deformed as needed such that the side face hook 246 is inserted into the hook inserting portion 336.

For example, when the hook extension 247 is in close contact with the first side face 242 or when the side face hook 246 is disposed on the inner face of the first side face 242, in the insertion process of the control panel 200, the first side face 242 itself of the control panel 200 deforms in a process in which the side face hook 246 reaches the hook inserting portion 336 of the first side end extension 332, resulting in inconvenience in the coupling or a damage.

However, in an embodiment of the present disclosure, as the side face hook 246 is disposed on the hook extension 247 spaced apart from the first side face 242, in the process of coupling the control panel 200 and the lower frame 300 with each other, the hook extension 247 is partially bent and the side face hook 246 is moved toward the hook inserting portion 336, so that effective coupling may be achieved.

In one example, the control panel 200 may have the second side face 244 disposed on the other side in the lateral direction Y, and the side end extension 330 may further include the second side end extension 334. The second side end extension 334 may be disposed on the other side in the lateral direction Y of the main frame face 310 to face toward the inner face of the second side face 244.

The second side face 244 of the control panel 200 may be penetrated by the penetrating member 248, and the second side end extension 334 of the lower frame 300 positioned on the inner face of the second side face 244 may include the through hole 338 into which the penetrating member 248 is coupled.

The through hole 338 may be penetrated by the penetrating member 248 like the second side face 244, or may be coupled to the penetrating member 248 as the penetrating member 248 penetrated the second side face 244 is inserted thereto. The penetrating member 248 may have various shapes such as a screw shape, a rivet shape, or the like.

In an embodiment of the present disclosure, the first side end extension 332 of the lower frame 300 is coupled with the first side face 242 of the control panel 200 through the hook inserting portion 336, and the second side end extension 334 of the lower frame 300 is coupled with the second side face 244 of the control panel 200 through the through hole 338, so that assembly efficiency may be improved and a structure having excellent coupling stability may be implemented.

For example, when both the first side end extension 332 and the second side end extension 334 of the lower frame 300 are coupled with the control panel 200 in a hook manner through the hook inserting portion 336, compared to the coupling using the penetrating member 248, the coupling stability may be lower, and it may be disadvantageous in separating the control panel 200 when necessary.

In addition, when both the first side end extension 332 and the second side end extension 334 of the lower frame 300 are coupled with the control panel 200 using the penetrating member 248, there is no means for the control panel 200 to be fixed at an appropriate position to be coupled with the lower frame 300, and a process and a component required for the assembly process are added, which may be disadvantageous.

Accordingly, in an embodiment of the present disclosure, the first side face 242 of the control panel 200 and the first side end extension 332 of the lower frame 300 are coupled with each other through the side face hook 246 and the hook inserting portions 336, so that the position of the control panel 200 at the beginning of the coupling of the control panel 200 may be effectively fixed.

In addition, the second side face 244 of the control panel 200 and the second side end extension 334 of the lower frame 300 are coupled with each other through the penetrating member 248 and the through hole 338 in a penetrating manner, so that a stable coupling structure in which coupling and separation are easy may be maintained.

Referring again to FIGS. 4 to 8, in an embodiment of the present disclosure, the main frame face 310 of the lower frame 300 may include the convex portion 316 that is curved such that a front face of the convex portion 316 is convex and a rear face of the convex portion 316 is concave to define a space at the rear.

The convex portion 316 may have a shape extending along the lateral direction Y of the lower frame 300 so as to be parallel with a longitudinal direction of the main frame face 310. In addition, as the front face of the convex portion 316 is convex and the rear face thereof is concave, the space is secured at the rear, so that the convex portion 316 and the components inside the first treating apparatus 10 do not interfere with each other.

FIG. 8 shows a state in which a base cabinet 15 of the first treating apparatus 10 is disposed at the rear of the main frame face 310 of the lower frame 300 according to an embodiment of the present disclosure. FIG. 8 shows that the convex portion 316 of the main frame face 310 is bent so as to correspond to the base cabinet 15, and thus, a space in which the base cabinet 15 is disposed is secured without interference between the base cabinet 15 and the lower frame 300 located at the rear. The base cabinet 15 may correspond to the first bottom panel of the first treating apparatus 10 or may be a component included in the first bottom panel.

The convex portion 316 may be formed to include the top of the main frame face 310, and the upper end extension 320 may extend from the convex portion 316. That is, the convex portion 316 may have a shape in which the space defined at the rear is opened upward.

The convex portion 316 may extend downward from the upper end of the main frame face 310 and may extend along the lateral direction Y. The connection hole 312 may be defined in the convex portion 316 or may be positioned avoiding the convex portion 316.

Because the lower frame 300 has the shape in which the convex portion 316 is formed on the top of the main frame face 310 and the space defined at the rear is opened upward, a space in which the base cabinet 15 and the like that may be positioned at the rear of the lower frame 300 may be effectively secured, and a support strength of the first front panel 112 supported by the upper end extension 320 may be effectively improved.

Figure 12:
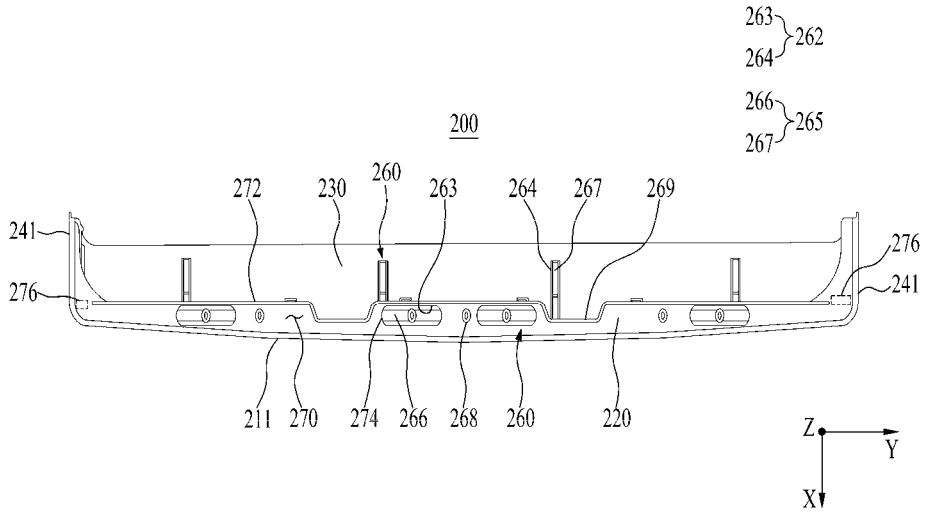
FIG. 12 is a top view showing a control panel of a laundry treating apparatus according to an embodiment of the present disclosure.
Figure 14:
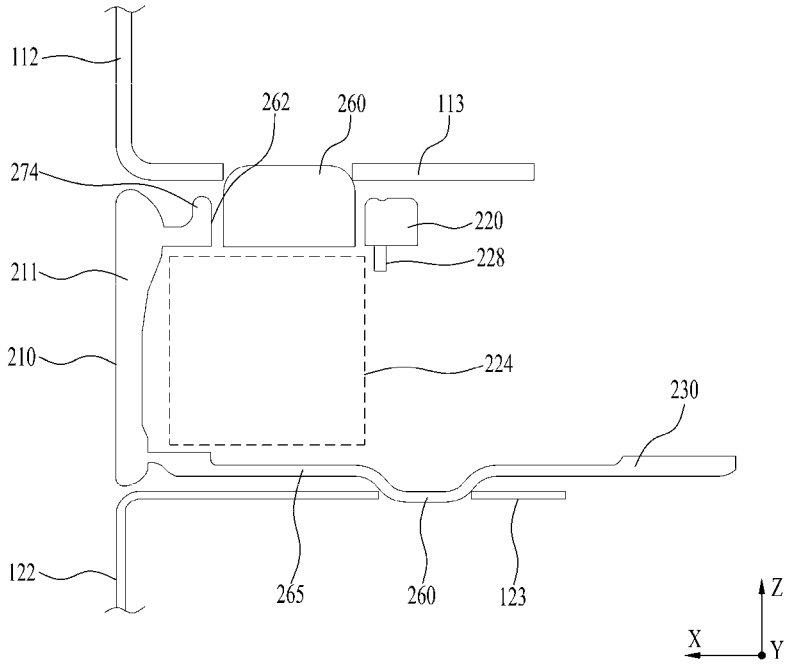
FIG. 14 is a cross-sectional view showing a coupling structure of a control panel and first and second front face panels in a laundry treating apparatus according to an embodiment of the present disclosure.

In one example, FIG. 12 shows a view of the control panel 200 viewed from the top, FIG. 13 shows a view of the bottom face 230 of the control panel 200 viewed from the rear, and FIG. 14 shows a cross-section of the control panel 200 coupled to the first front panel 112 and the second front panel 122.

Referring to FIGS. 12 to 14, in the laundry treating apparatus 1 according to an embodiment of the present disclosure, the control panel 200 may be fixed as the top thereof is coupled to the bottom of the first front panel 112 and the bottom thereof is coupled to a top of the second front panel 122.

For example, in the control panel 200, the top face 220 may be coupled to the bottom of the first front panel 112, and the bottom face 230 of the control panel 200 may be coupled to the top of the second front panel 122. As described above, the control panel 200 may form the stable coupling structure as the side faces 240 are coupled to the lower frame 300, and at the same time, the top face 220 and the bottom face 230 are respectively coupled to the first front panel 112 and the second front panel 122.

The control panel 200 may be coupled with the first front panel 112 and the second front panel 122 in various schemes. For example, the control panel 200 in front of the lower frame 300 may move rearward to be inserted between the first front panel 112 and the second front panel 122. In the insertion process of the control panel 200, panel fastening portions 260 that may be arranged on the top face 220 and the bottom face 230 may be respectively coupled to the first front panel 112 and the second front panel 122 as will be described later.

Referring to FIG. 14, in an embodiment of the present disclosure, the second front panel 122 may include an upper end bending portion 123 extending rearward from an upper end of a front face of the second front panel 122. The upper end bending portion 123 may be bent from the front face of the second front panel 122.

The top of the control panel 200 may be coupled to the lower end bending portion 113 of the first front panel 112, and the bottom of the control panel 200 may be coupled to the upper end bending portion 123 of the second front panel 122. Specifically, the control panel 200 inserted between the first front panel 112 and the second front panel 122 is constructed such that the top thereof, that is, the top face 220 faces toward the lower end bending portion 113 of the first front panel 112, and the bottom thereof, that is, the bottom face 230 faces toward the upper end bending portion 123 of the second front panel 122.

The top face 220 of the control panel 200 may be disposed in parallel with the lower end bending portion 113 of the first front panel 112, and the bottom face 230 of the control panel 200 may be disposed in parallel with the upper end bending portion 123 of the second front panel 122. Furthermore, the lower end bending portion 113 of the first front panel 112 and the upper end bending portion 123 of the second front panel 122 may also be arranged to be in parallel with each other.

In the insertion process of the control panel 200, the top face 220 disposed at the top of the control panel 200 may be coupled to the lower end bending portion 113 of the first front panel 112, and the bottom face 230 disposed at the bottom of the control panel 200 may be coupled to the upper end bending portion 123 of the second front panel 122.

In one example, FIG. 12 shows the panel fastening portion 260 disposed on the top face 220 of the control panel 200, and FIG. 13 shows the panel fastening portion 260 disposed on the bottom face 230 of the control panel 200. Referring to FIGS. 12 and 13, the top face 220 and the bottom face 230 may include the panel fastening portions 260 respectively inserted into and coupled to the lower end bending portion 113 and the upper end bending portion 123 respectively facing thereto.

The panel fastening portion 260 may be formed in a hook shape and be coupled to the lower end bending portion 113 or the upper end bending portion 123, or may be formed in a protrusion shape and be inserted into and coupled to the lower end bending portion 113 or the upper end bending portion 123.

FIGS. 12 and 13 show the panel fastening portions 260 that are respectively inserted into and coupled to the lower end bending portion 113 of the first front panel 112 and the upper end bending portion 123 of the second front panel 122 as shown in FIG. 14 according to an embodiment of the present disclosure. The number, a position, and a shape of the panel fastening portion 260 may be various as needed.

In one example, in an embodiment of the present disclosure, each of the top face 220 and the bottom face 230 may include an opening 262 open in the vertical direction Z and a fastening elastic portion 265 extending from an inner face of the opening 262 to intersect the opening 262. The panel fastening portion 260 of each of the top face 220 and the bottom face 230 may be disposed on the fastening elastic portion 265.

Specifically, a top face opening 263 may be defined in the top face 220 and a bottom face opening 264 may be defined in the bottom face 230. Each of the top face opening 263 and the bottom face opening 264 may have a shape open in the vertical direction Z and may penetrate each of the top face 220 and the bottom face 230.

The fastening elastic portion 265 may include a top face fastening elastic portion 266 disposed on the top face 220 and a bottom face fastening elastic portion 267 disposed on the bottom face 230. The top face fastening elastic portion 266 may be disposed to intersect the top face opening 263 of the top face 220, and the bottom face fastening elastic portion 267 may be disposed to intersect the bottom face opening 264 of the bottom face 230.

The fastening elastic portion 265 may extend in parallel with the top face 220 or the bottom face 230 from the inner face of each opening 262. For example, the fastening elastic portion 265 may extend from one side of the inner face of the opening 262 and may be connected to the other side of the inner face of the opening 262.

That is, the fastening elastic portion 265 may be disposed on the opening 262. Both ends of the fastening elastic portion 265 are connected to the top face 220 or the bottom face 230 of the control panel 200 in a longitudinal direction, and the remaining portion thereof is separated from the top face 220 or the bottom face 230.

Each opening 262 may have a shape extending in parallel with the longitudinal direction of the fastening elastic portion 265, and may be at least partially shielded in the vertical direction Z by the fastening elastic portion 265.

For example, the fastening elastic portion 265 may be formed by cutting both sides thereof from the top face 220 or the bottom face 230 along the longitudinal direction of the fastening elastic portion 265. Accordingly, the both ends of the fastening elastic portion 265 connected to the inner face of the opening 262 are fixed, so that a center of the fastening elastic portion 265 may be separated from the top face 220 or the bottom face 230 and be elastically deformed.

In an embodiment of the present disclosure, as the panel fastening portion 260 is disposed on the fastening elastic portion 265, in the insertion process of the control panel 200, the fastening elastic portion 265 is deformed in a process in which each panel fastening portion 260 is moved toward the lower end bending portion 113 of the first front panel 112 or the upper end bending portion 123 of the second front panel 122, and the fastening elastic portion 265 is restored as the panel fastening portion 260 reaches each coupling point, so that the coupling structure may be formed.

FIG. 12 shows the top face opening 263 and the top face fastening elastic portion 266 respectively defined in and disposed on the top face 220 of the control panel 200, and FIG. 13 shows the bottom face opening 264 and the bottom face fastening elastic portion 267 respectively defined in and disposed on the bottom face 230 of the control panel 200.

Figure 15:
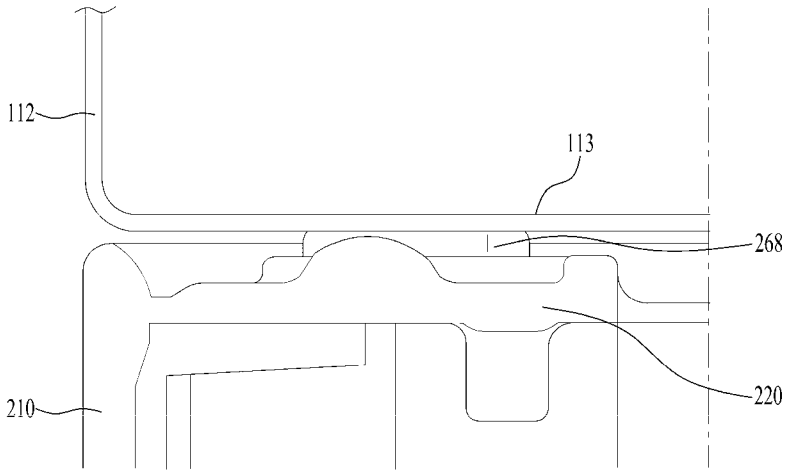
FIG. 15 is a view showing a panel supporting portion of a control panel in a laundry treating apparatus according to an embodiment of the present disclosure.

In one example, FIG. 12 shows a panel supporting portion 268 disposed on the top face 220 of the control panel 200 according to an embodiment of the present disclosure, and FIG. 15 shows the panel supporting portion 268 supporting the lower end bending portion 113 of the first front panel 112 from below.

Specifically, the panel supporting portion 268 may be distinguished from the panel fastening portion 260, and an upper end of the panel supporting portion 268 may upwardly support the lower end bending portion 113 of the first front panel 112. The number and a shape of the panel supporting portions 268 may be various, and the panel supporting portion 268 may have a top face in parallel with the lower end bending portion 113.

The panel supporting portion 268 may protrude upward from the top face 220 of the control panel 200 like the panel fastening portion 260. However, unlike the panel fastening portion 260 inserted into the lower end bending portion 113, the panel supporting portion 268 may be in contact with the bottom face of the lower end bending portion 113 to support the lower end bending portion 113. The panel supporting portion 268 may have a protrusion shape like the panel fastening portion 260.

In an embodiment of the present disclosure, as the panel supporting portion 268 supporting the bottom of the first front panel 112 is disposed on the top face 220 of the control panel 200, the first front panel 112 may be stably supported. Furthermore, because the panel supporting portion 268 of the control panel 200 supports the first front panel 112 together with the top support 356 of the lower frame 300, structural stability may be improved.

In one example, in an embodiment of the present disclosure, the panel fastening portion 260 may have a protrusion height greater than that of the panel supporting portion 268. Accordingly, an entirety of the lower end bending portion 113 may have a flat face, and a shape in which the panel fastening portion 260 is inserted into the lower end bending portion 113 of the first front panel 112, and the panel supporting portion 268 supports the lower end bending portion 113 may be realized.

Referring again to FIGS. 9 and 10, in an embodiment of the present disclosure, the top face 220 of the control panel 200 may have a coupling portion receiving groove 269 into which the top coupling portion 350 of the lower frame 300 is inserted and received.

Specifically, in an embodiment of the present disclosure, the top face 220 of the control panel 200 may be inserted between the lower end bending portion 113 and the upper end extension 320, and as described above, the upper end extension 320 may include the top coupling portion 350 protruding upward and inserted into the lower end bending portion 113.

In addition, the top face 220 may include the coupling portion receiving groove 269 that is opened rearward, and the top coupling portion 350 is inserted into the coupling portion receiving groove 269 from the rear.

The coupling portion receiving groove 269 may have a shape extending in the front and rear direction X in consideration of an insertion direction of the control panel 200, and a width of the coupling portion receiving groove 269 may be greater than that of the top coupling portion 350. A rear end of the coupling portion receiving groove 269 may be disposed to face toward the top coupling portion 350 and opened rearward, so that the top coupling portion 350 may be inserted into the coupling portion receiving groove 269 through the open rear end of the coupling portion receiving groove 269.

That is, in the process in which the control panel 200 in front of the lower frame 300 is moved rearward and inserted, the top coupling portion 350 of the lower frame 300 may move forward from the rear of the coupling portion receiving groove 269 and be inserted into the coupling portion receiving groove 269.

Accordingly, the upper end extension 320 having the top coupling portion 350 coupled to the first front panel 112 and supporting the first front panel 112 is included in the lower frame 300. In the structure in which the top face 220 of the control panel 200 is inserted between the upper end extension 320 and the lower end bending portion 113 of the first front panel 112, the top coupling portion 350 protruding from the upper end extension 320 of the lower frame 300 toward the lower end bending portion 113 may be positioned without structural interference by the coupling portion receiving groove 269. In addition, the top face 220 of the control panel 200 may also be inserted between the first front panel 112 and the upper end extension 320 of the lower frame 300 without interference by the top coupling portion 350.

In one example, FIG. 13 shows an electric parts coupling portion 228 protruding downward from the inner face of the top face 220 of the control panel 200, and FIG. 14 schematically shows the electric parts 224 and the electric parts coupling portion 228.

Referring to FIGS. 13 and 14, in an embodiment of the present disclosure, the control panel 200 may further include the electric parts 224 and the electric parts coupling portion 228, and the upper end extension 320 of the lower frame 300 may include a front receiving groove 324 into which the electric parts coupling portion 228 is inserted and received.

The electric parts coupling portion 228 may protrude downward from the inner face of the top face 220 and may be coupled to the electric parts 224 inside the control panel 200. The electric parts coupling portion 228 may include a plurality of electric parts coupling portions. The electric parts coupling portion 228 may have a protrusion shape as shown in FIG. 13 and be inserted into and coupled to a groove defined in the electric parts 224, or may be disposed to rearwardly support a rear face of the electric parts 224 as shown in FIG. 14.

In one example, the upper end extension 320 of the lower frame 300 may be located below the top face 220 of the control panel 200, and thus, in the insertion process of the control panel 200, the electric parts coupling portion 228 may be in contact with a front end of the upper end extension 320 and interfere with the movement of the control panel 200.

Accordingly, in an embodiment of the present disclosure, the front receiving groove 324 into which the electric parts coupling portion 228 is inserted and received may be defined at the front end of the upper end extension 320.

The front receiving groove 324 may be defined to face toward the electric parts coupling portion 228. That is, the front receiving groove 324 may be located at the rear of the electric parts coupling portion 228. The front receiving groove 324 may extend in the front and rear direction X in consideration of the coupling direction of the control panel 200, and a front end of the front receiving groove 324 may be opened forward.

In the process in which the control panel 200 is inserted between the first front panel 112 and the second front panel 122, the electric parts coupling portion 228 may be inserted into the front receiving groove 324 through the open front end of the front receiving groove 324. FIG. 9 shows the front receiving groove 324 defined in the upper end extension 320 of the lower frame 300.

In one example, as shown in FIG. 14, in an embodiment of the present disclosure, a length of the top face 220 of the control panel 200 extending rearward from the front face 210 may be less than a length of the bottom face 230 extending rearward from the front face 210, so that the interference with the upper end extension 320 of the lower frame 300 may be prevented.

As described above, the top face 220 of the control panel 200 may be disposed adjacent to the upper end extension 320 of the lower frame 300 in the vertical direction Z. The upper end extension 320 of the lower frame 300 has the top coupling portion 350 coupled to the first front panel 112, and the top face 220 of the control panel 200 may have the electric parts coupling portion 228.

As such, the upper end extension 320 of the lower frame 300 and the top face 220 of the control panel 200 may respectively have components for the coupling and the support in a relationship therebetween, which may cause the structural interference therebetween.

In consideration of the above structural features, in an embodiment of the present disclosure, the top face 220 of the control panel 200 is formed to have a smaller length than the bottom face 230, so that the structural interference between the upper end extension 320 of the lower frame 300 and the top face 220 of the control panel 200 may be prevented, and structural degrees of freedom therebetween may be effectively improved.

In one example, as described above, the top face opening 263 and the top face fastening elastic portion 266 may be respectively defined in and disposed on the top face 220 of the control panel 200, and the bottom face opening 264 and the bottom face fastening elastic portion 267 may be respectively defined in and disposed on the bottom face 230 of the control panel 200.

In addition, referring to FIGS. 12 and 13, in an embodiment of the present disclosure, the top face fastening elastic portion 266 may be disposed to intersect the top face opening 263 along the lateral direction Y of the control panel 200, and the bottom face fastening elastic portion 267 may be disposed to intersect the bottom face opening 264 along the front and rear direction X of the control panel 200.

That is, the top face fastening elastic portion 266 may extend along the lateral direction Y of the control panel 200, and the bottom face fastening elastic portion 267 may extend along the front and rear direction X of the control panel 200. The top face opening 263 may also extend in the lateral direction Y like the top face fastening elastic portion 266, and the bottom face opening 264 may also extend in the front and rear direction X like the bottom face fastening elastic portion 267.

As described above, at least a portion of the upper end extension 320 of the lower frame 300 overlaps the top face 220 of the control panel 200 and has a coupling relationship with the first front panel 112 and the like, so that the top face 220 of the control panel 200 may have a length of extending from the front face 210 that is smaller than that of the bottom face 230 to minimize the structural interference with the upper end extension 320.

Accordingly, the top face fastening elastic portion 266 disposed on the top face 220 has a disadvantage in extending in the front and rear direction X because of the small length of the top face 220. Accordingly, the top face fastening elastic portion 266 may extend in the lateral direction Y of the control panel 200. The top face opening 263 may also extend in the lateral direction Y like the top face fastening elastic portion 266.

In addition, because of the characteristics of the bottom face 230 having the larger extension length compared to the top face 220, the bottom face fastening elastic portion 267 disposed on the bottom face 230 may extend in the front and rear direction X unlike the top face fastening elastic portion 266, and the bottom face opening 264 may also extend in the front and rear direction X like the bottom face fastening elastic portion 267. The panel fastening portion 260 may protrude upward from the top face fastening elastic portion 266 and may protrude downward from the bottom face fastening elastic portion.

In one example, referring to FIG. 12 again, the laundry treating apparatus 1 according to an embodiment of the present disclosure may have a drain passage 270 extending in the lateral direction Y defined in the top face 220 of the control panel 200.

The drain passage 270 may extend along the lateral direction Y on the top face 220, and water falling to the top face 220 may be drained by flowing in the lateral direction Y along the drain passage 270.

Specifically, as described above, the water may exist inside the first treating apparatus 10 and the second treating apparatus 20, such as a washing machine or a condensing dryer, and the water may leak or may be generated in other operating situations of the first treating apparatus 10.

The water may fall along the first treating apparatus 10 or may be supplied to the control panel 200 in other schemes. As described above, the control panel 200 may have the display and the manipulation unit on the front face thereof, and may have the electric parts 224 therein. Therefore, it is necessary to prevent the water existing on the control panel 200 from flowing into the control panel 200 or flowing along the front face 210.

Accordingly, an embodiment of the present disclosure may define the drain passage 270 in the top face 220 of the control panel 200, and the inflow of the water supplied to the top face 220 of the control panel 200 to the front face 210 or the interior of the control panel 200 may be minimized through the drain passage 270.

In addition, because the control panel 200 is located below the first front panel 112, in consideration of the situation in which the water flowing downward along the first front panel 112 falls to the top face 220 of the control panel 200, in an embodiment of the present disclosure, the drain passage 270 may be defined in the top face 220 of the control panel 200.

The drain passage 270 may be formed in various shapes, and may be formed in various schemes as necessary. FIG. 12 shows a state in which the drain passage 270 opened upward is disposed on the top face 220 according to an embodiment of the present disclosure.

The drain passage 270 may extend along the lateral direction Y of the control panel 200. Accordingly, the water falling to the top face 220 may flow in the lateral direction Y on the top face 220, and a phenomenon in which the water passes the rear end of the top face 220 and flows into the control panel 200 or flows along the front face 210 of the control panel 200 may be suppressed.

In one example, referring to FIG. 12 along with FIG. 9, in an embodiment of the present disclosure, the upper end 211 of the front face 210 is located above the top face 220. The top face 220 may have a passage rib 272 protruding upward and extending in the lateral direction Y at a rear end thereof. The drain passage 270 may be formed by the upper end 211 of the front face 210 and the passage rib 272.

Specifically, the top face 220 of the control panel 200 may extend rearward from the upper end of the front face 210, and the upper end 211 of the front face 210 may be positioned higher than the top face 220. That is, the top face 220 may extend rearward from the front face 210 at a vertical level lower than that of the upper end 211 of the front face 210. In other words, the front face 210 may extend upward such that the upper end 211 is positioned higher than the top face 220.

In addition, the passage rib 272 protruding upward and extending along the lateral direction Y may be disposed at the rear end of the top face 220. The top face 220 may extend in the lateral direction Y of the control panel 200 like the front face 210, and the passage rib 272 may also extend in the lateral direction Y along the top face 220.

In addition, as described above, the top face 220 may have the coupling portion receiving groove 269 defined therein that is opened rearward at the rear end thereof. A specific extending shape of the passage rib 272 may correspond to a shape of the rear end of the top face 220. That is, the passage rib 272 may extend along the rear end of the top face 220.

The drain passage 270 may be defined in the top face 220 by the upper end 211 and the passage rib 272 of the front face 210.

That is, the upper end of the front face 210 may form one side wall of the drain passage 270, the passage rib 272 may form an opposite side wall to said one side wall of the drain passage 270, and the top face of the top face 220 may form a bottom face of the drain passage 270 to form the drain passage 270.

In an embodiment of the present disclosure as above, the drain passage 270 may be formed on an entirety of the top face of the top face 220. Accordingly, the water falling to or flowing to the top face 220 may be entirely located in the drain passage 270, or may be drained by flowing in the lateral direction Y along the drain passage 270.

In one example, in an embodiment of the present disclosure, an upper end 241 of each side face 240 of the control panel 200 may be located above the top face 220, and both ends of the passage rib 272 in the lateral direction Y may be respectively spaced apart from the side faces 240 respectively facing thereto, so that each drainage 276 may be defined between the upper end 241 of each side face 240 and the passage rib 272.

Specifically, each side face 240 extending rearward from each of both sides in the lateral direction Y of the front face 210 has the upper end 241 positioned higher than the top face 220 like the front face 210. The upper end 211 of the front face 210 and the upper end 241 of the side face 240 may extend integrally. Accordingly, the top face 220 may be disposed such that the front end and both side ends thereof are surrounded by the upper end 211 of the front face 210 and the upper end 241 of the side face 240.

Both side ends of the passage rib 272 in the lateral direction Y may be respectively spaced apart from the upper ends of the side faces 240 respectively facing thereto. That is, in the drain passage 270, an opening may be defined between each side end of the passage rib 272 and the upper end of each side face 240 to define the drainage 276. The water present on the top face 220 may be discharged from the top face 220 through the drainage 276.

In one example, both sides in the lateral direction Y of the electric parts 224 that may be arranged inside the control panel 200 may be respectively spaced apart from the inner faces of the side faces 240 by a predetermined distance so as to be prevented from contacting the water discharged through the drainage 276.

As above, by the drain passage 270 defined by the upper end of the front face 210 and the upper ends of the side faces 240, the water falling on the top face 220 may be prevented from leaking to the outside along the front face 210 or the side faces 240, and may be discharged rearward from the both sides in the lateral direction Y of the control panel 200 through the drainages 276 respectively defined between the passage rib 272 and the side faces 240.

In addition, as shown in FIG. 12, the panel supporting portion 268 and the panel fastening portion 260 arranged on the top face 220 of the control panel 200 may be located in the drain passage 270. As described above, the panel supporting portion 268 may be disposed on the drain passage 270 to support the lower end bending portion 113 of the first front panel 112, and the panel fastening portion 260 may be disposed on the drain passage 270 and penetrate the lower end bending portion 113.

The panel supporting portion 268 and the panel fastening portion 260 may respectively include a plurality of panel supporting portions and a plurality of panel fastening portions, may be arranged in lateral direction Y along the drain passage 270, and may be arranged to alternate with each other. Accordingly, a supporting force of the first front panel 112 by the panel supporting portion 268 and a fixing force of the first front panel 112 by the panel fastening portion 260 may be properly mixed and dispersed.

In one example, in an embodiment of the present disclosure, the top face 220 may further include an inflow prevention rib 274. The inflow prevention rib 274 may extend to surround the opening 262 defined in the top face 220 and protrude upward to prevent the water from flowing into the opening 262. The opening 262 may be the top face opening 263 on which the top face fastening elastic portion 266 is disposed.

The panel fastening portion 260 may be disposed in the drain passage 270 and may be disposed on the fastening elastic portion 265 disposed with the opening 262. That is, the opening 262 on which the fastening elastic portion 265 is formed may be defined in the drain passage 270, and the water on the top face 220 may fall into the control panel 200 through the opening 262.

Accordingly, in an embodiment of the present disclosure, the inflow prevention rib 274 surrounding the opening 262 may be formed on the top face 220 to prevent the water leakage through the opening 262.

The inflow prevention rib 274 may extend in a ring shape to surround a circumference of the opening 262. The ring shape may be various depending on the shape of the opening 262, and may have, for example, a polygonal or circular cross-section.

As a result, while being prevented from flowing into the opening 262 by the inflow prevention rib 274, the water on the drain passage 270 defined by the upper end of the front face 210 and the passage rib 272 may flow in the lateral direction Y along the drain passage 270 and be drained.

In one example, as described above, in an embodiment of the present disclosure, the coupling portion receiving groove 269 may be defined in the top face 220. The passage rib 272 extending along the rear end of the top face 220 may be extended so as to correspond to the coupling portion receiving groove 269, so that the water leakage into the coupling portion receiving groove 269 may be prevented.

A portion of the passage rib 272 extending along the coupling portion receiving groove 269 may extend to correspond to the shape of the coupling portion receiving groove 269. FIG. 12 shows the passage rib 272 that extends by being bent or curved to correspond to the coupling portion receiving groove 269 having an approximately rectangular cross-section, according to an embodiment of the present disclosure.

Figure 16:
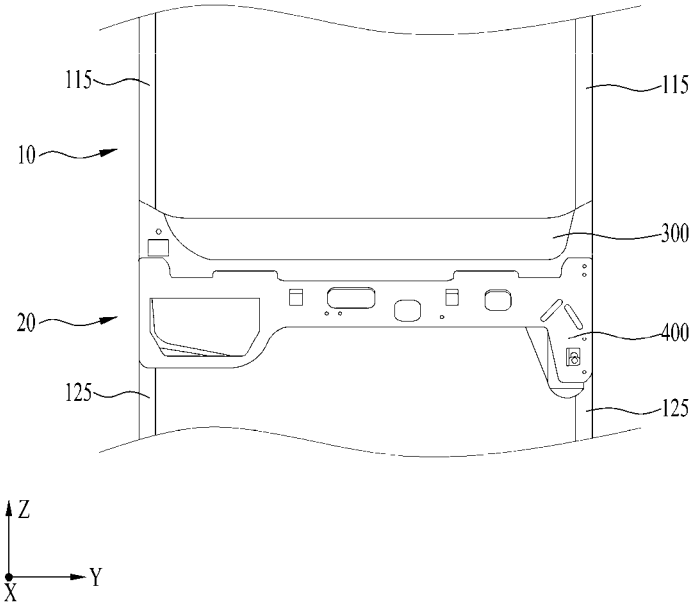
FIG. 16 is a view showing a lower frame and an upper frame in a laundry treating apparatus according to an embodiment of the present disclosure.

In one example, FIG. 16 shows the laundry treating apparatus 1 in which the first front panel 112 and the second front panel 122 are omitted, and shows the lower frame 300 of the first treating apparatus 10 and an upper frame 400 of the second treating apparatus 20. In addition, FIG. 17 shows an exploded perspective view of the lower frame 300 and the upper frame 400.

Figure 17:
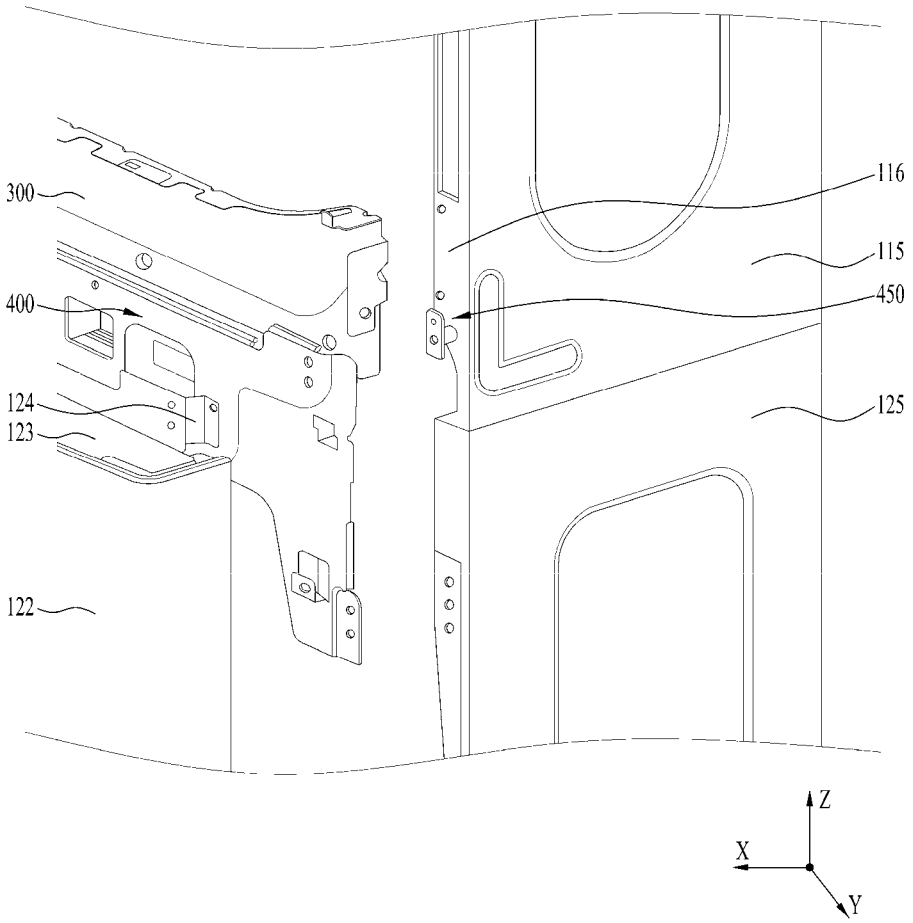
FIG. 17 is a view showing a state in which a lower frame and an upper frame are separated from a laundry treating apparatus according to an embodiment of the present disclosure.

Referring to FIGS. 16 and 17, the laundry treating apparatus 1 according to an embodiment of the present disclosure may include the upper frame 400. The upper frame 400 may be disposed on a rear face of the second front panel 122, and may be coupled to the first side panels 115 through insulating connection members 450 made of an insulating material, so that the upper frame 400 may be insulated from the first side panels 115.

Specifically, the upper frame 400 may be located at a top of the front face of the second treating apparatus 20, and may be coupled to the first treating apparatus 10 to fasten the first treating apparatus 10 and the second treating apparatus 20 with each other.

The upper frame 400 may be disposed on the rear face of the second front panel 122, and may be disposed in front of the second top panel and the second side panels 125 of the second treating apparatus 20 as shown in FIG. 17. That is, the upper frame 400 may be disposed between the second front panel 122 and each second side panel 125.

FIG. 16 shows a state in which a detergent-storage receiving opening penetrated by a detergent storage unit for supplying detergent is defined in the second treating apparatus 20. That is, in FIG. 16, the second treating apparatus 20 may correspond to the washing machine that treats the laundry using the detergent, and the detergent-storage receiving opening penetrated by the detergent storage unit may be defined in the upper frame 400.

The upper frame 400 may be coupled with the second side panels 125 respectively on the both sides in the lateral direction Y, and may be coupled with the second front panel 122 at the front. The upper frame 400 may contribute to improving structural stability and stiffness of the top of the second treating apparatus 20.

The upper frame 400 may be fixed to the second treating apparatus 20, and an upper portion thereof extending upward may be coupled to the lower portion of the first treating apparatus 10. The upper frame 400 may have a face parallel to the second front panel 122 and may be disposed on the front face of the second treating apparatus 20.

In one example, in an embodiment of the present disclosure, the first treating apparatus 10 and the second treating apparatus 20 may correspond to apparatuses that are independent of each other, and may respectively have components that use electricity, such as the motor, the controller, or the like, therein.

When a situation in which the electricity leaks from one of the first treating apparatus 10 and the second treating apparatus 20 occurs, it is necessary to prevent the leaked electricity from affecting the other.

That is, the first treating apparatus 10 and the second treating apparatus 20 need to be electrically insulated from each other, so that electric leakage does not occur therebetween.

Accordingly, an embodiment of the present disclosure may use the insulating connection member 450 for fastening the upper frame 400 of the second treating apparatus 20 with the first treating apparatus 10, and the upper frame 400 may be connected to the first treating apparatus 10 through the insulating connection member 450.

The insulating connection member 450 may be made of the insulating material. The insulating material may be selected as various materials according to need, such as a plastic material, a rubber material, a mixed material of the plastic and the rubber, or the like.

The upper frame 400 may have a coupling relationship with the first front panel 112 or the first side panels 115 of the first treating apparatus 10 or other components of the first treating apparatus 10, and may be fastened to the first treating apparatus 10 through the insulating connection member 450.

That is, the insulating connection member 450 may insulate the upper frame 400 and the first treating apparatus 10 from each other while coupling the upper frame 400 with the component of the first treating apparatus 10. FIGS. 16 and 17 show a state in which the upper frame 400 is coupled to the first side panels 115 of the first treating apparatus 10 and is insulated from the first side panels 115 through the insulating connection members 450, according to an embodiment of the present disclosure.

The insulating connection member 450 may be formed in various shapes, and may fasten the first treating apparatus 10 with the upper frame 400 in various fastening schemes. For example, the insulating connection member 450 may have the various fastening schemes, such as being formed in a hook shape, including a coupling member inserted therein, or being adhered to one face of the upper frame 400.

In one example, referring to FIG. 17, in an embodiment of the present disclosure, in the upper frame 400, lower portions of both side portions in the lateral direction Y may be respectively coupled to the second side panels 125, and upper portions of the both side portions may be respectively coupled to the first side panels 115 through the insulating connection members 450.

The upper frame 400 may have a face parallel to the front face of the second front panel 122, and may extend in the lateral direction Y, so that at least portions of the both side portions in the lateral direction Y may be arranged in front of the second side panels 125.

The lower portions of the both side portions of the upper frame 400 may be respectively coupled to the second side panels 125, and the upper portions of the both side portions may be respectively coupled to the first side panels 115. That is, the both sides in the lateral direction Y of the upper frame 400 may be coupled together to the first front panel 112 of the first treating apparatus 10 and the second front panel 122 of the second treating apparatus 20.

The coupling scheme of the upper frame 400 may be various. For example, a hook may be formed on the upper frame 400 and coupled to the first front panel 112 and/or the second front panel 122, and the upper frame 400 may be coupled to the first front panel 112 and/or the second front panel 122 through the coupling member such as a screw or the like as shown in FIG. 17.

Figure 18:
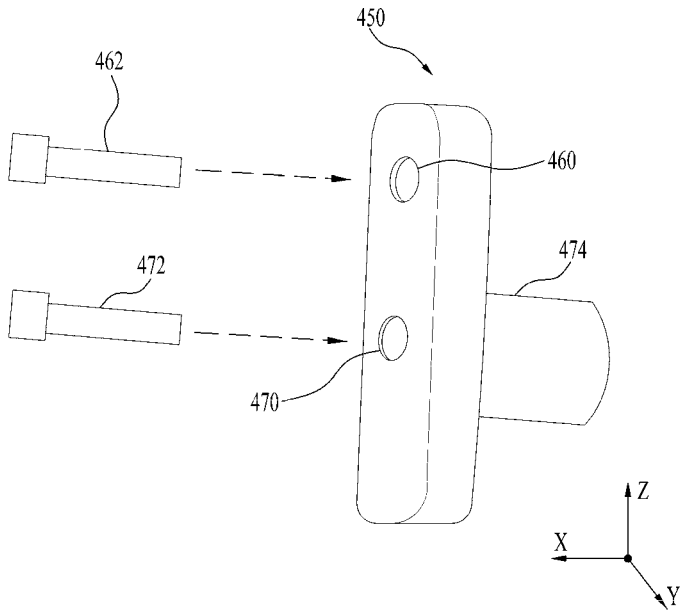
FIG. 18 is a view showing an insulating connection member in a laundry treating apparatus according to an embodiment of the present disclosure.

In one example, FIG. 17 shows each insulating connection member 450 that couples the upper frame 400 and each first side panel 115 with each other, and FIG. 18 shows a perspective view of the insulating connection member 450. In addition, FIG. 19 is a cross-sectional view showing the coupling structure of each first side panel 115, the insulating connection member 450, and the upper frame 400.

Figure 19:
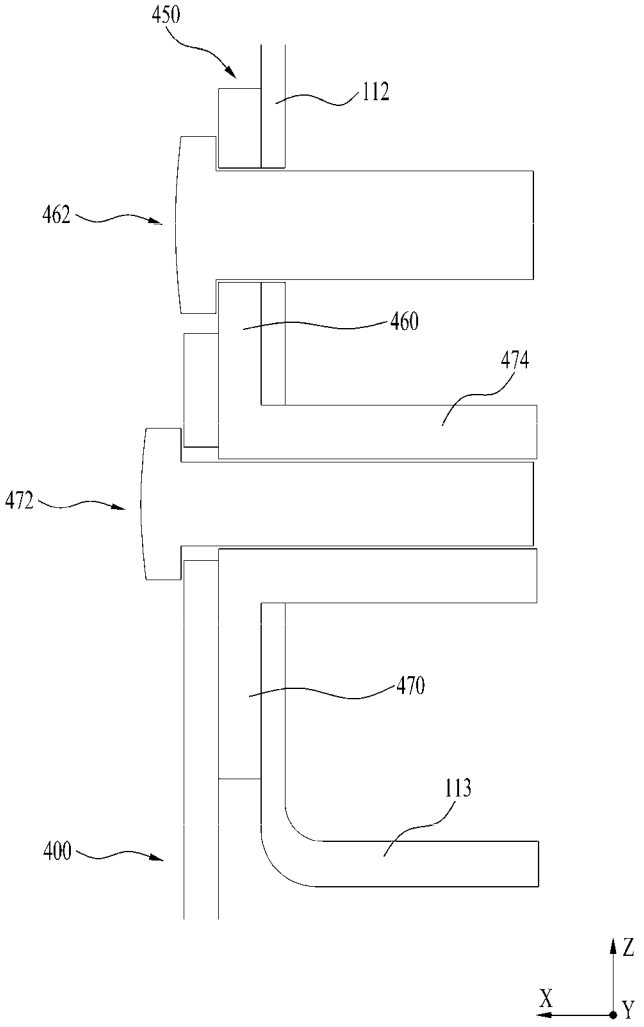
FIG. 19 is a cross-sectional view showing a coupling structure of an insulating connection member and an upper frame in a laundry treating apparatus according to an embodiment of the present disclosure.

Referring to FIGS. 17 to 19, in an embodiment of the present disclosure, each insulating connection member 450 may include a first fastening hole 460 and a second fastening hole 470 defined therein. The first fastening hole 460 may be coupled to the first side panel 115, the second fastening hole 470 may be coupled to the upper frame 400, and the second fastening hole 470 may insulate the upper frame 400 and the first side panel 115 from each other.

Specifically, the insulating connection member 450 may have the first fastening hole 460 and the second fastening hole 470 connected to each other. The insulating connection member 450 may be fixed to the first side panel 115 as the first fastening hole 460 is coupled to the first side panel 115.

In addition, for example, the upper portions of the both side portions of the upper frame 400 may be respectively coupled to the second fastening holes 470, and thus, the upper frame 400 may be fixed to the insulating connection members 450. That is, the upper frame 400 is fixed to the insulating connection members 450, and the insulating connection members 450 are respectively fixed to the first side panels 115, thereby the fixing structure of the coupling structure between the upper frame 400 and the first side panel 115 may be formed.

The coupling scheme between the first fastening hole 460 and the first side panel 115 and the coupling scheme between the second fastening hole 470 and the upper frame 400 may be variously determined as needed. For example, a fitting coupling, a hook coupling, or the like may be used, or the coupling relationship may be formed through a fastening member penetrating the insulating connection member 450 as shown in FIGS. 18 and 19.

The upper frame 400 is coupled to the first side panels 115 through the insulating connection members 450 made of the insulating material, so that the insulation between the upper frame 400 and the first side panels 115 may be achieved by the insulating connection members 450.

For example, as shown in FIG. 19, the second fastening hole 470 of the upper frame 400 may be positioned between the upper frame 400 and the first side panel 115 to prevent direct contact between the upper frame 400 and the first side panel 115, thereby insulating the upper frame 400 and the first side panel 115 from each other.

In one example, the first fastening hole 460 may extend upward from the second fastening hole 470 coupled with the upper frame 400, and the upper frame 400 coupled to the second fastening hole 470 may be fastened to the first side panel 115 through the first fastening hole 460.

The both side portions of the upper frame 400 extending upward from the second treating apparatus 20 are respectively coupled to the second fastening holes 470, and the first fastening holes 460 are respectively coupled to the first side panels 115 while being respectively coupled to the second fastening holes 470, so that the first fastening hole 460 may be located above the second fastening hole 470.

That is, the first fastening hole 460 located at an upper portion of each insulating connection member 450 may be coupled to each first side panel 115, and the second fastening hole 470 located at a lower portion of each insulating connection member 450 may be coupled to the upper frame 400 while facing each side portion of the upper frame 400.

In other words, the first fastening hole 460 may be defined extending upward from the second fastening hole 470, and the second fastening hole 470 may be defined extending downward from the first fastening hole 460.

In one example, the laundry treating apparatus 1 according to an embodiment of the present disclosure may further include a first fastening member 462 and a second fastening member 472. The first fastening member 462 may penetrate the first fastening hole 460 and the first side panel 115 together to fasten the first fastening hole 460 with the first side panel 115, and the second fastening member 472 may penetrate the upper frame 400 and be inserted into the second fastening hole 470 to fasten the upper frame 400 with the second fastening hole 470. The second fastening hole 470 may insulate the second fastening member 472 and the first side panel 115 from each other.

Specifically, each insulating connection member 450 may be coupled to each first side panel 115 and the upper frame 400 through each first fastening member 462 and each second fastening member 472. The first fastening member 462 may be formed in a shape of a screw, a rivet, or the like, and may penetrate the first fastening hole 460 and the first side panel 115 together.

Because the first fastening member 462 is not directly in contact with the upper frame 400, the first fastening hole 460 does not need to insulate the first fastening member 462 and the first side panel 115 from each other.

In one example, the upper frame 400 may be penetrated by the second fastening member 472, and the second fastening member 472 penetrated the upper frame 400 may be coupled to the second fastening hole 470 of the insulating connection member 450. In this connection, the second fastening hole 470 may be defined to insulate the second fastening member 472 and the first side panel 115 from each other.

The second fastening member 472 that may penetrate the upper frame 400 and may be in contact with and electrically connected to the upper frame 400 needs to be electrically insulated from the first side panel 115. Accordingly, the insulating connection member 450 according to an embodiment of the present disclosure may be constructed such that the second fastening hole 470 insulates the second fastening member 472 and the first side panel 115 from each other.

There may be various schemes of insulating, by the second fastening hole 470, the second fastening member 472 and the first side panel 115 from each other. For example, the second fastening hole 470 may be disposed in front of the first side panel 115, and the second fastening member 472 may be inserted into and coupled to only the second fastening hole 470 excluding the first side panel 115 in the state of penetrating the upper frame 400, so that the second fastening member 472 may be insulated from the first side panel 115.

Alternatively, as shown in FIGS. 18 to 19, the second fastening hole 470 may be defined to surround the second fastening member 472 to insulate the first side panel 115 and the second fastening member 472 from each other.

In one example, as shown in FIGS. 17 to 19, in an embodiment of the present disclosure, the second fastening hole 470 may include a fastening insulating portion 474. The fastening insulating portion 474 may extend to penetrate the first side panel 115, at least a portion of the second fastening member 472 may be inserted into the fastening insulating portion 474, and the fastening insulating portion 474 may insulate the second fastening member 472 and the first side panel 115 from each other.

The fastening insulating portion 474 may be formed in a hollow shape, and may extend along an insertion direction of the second fastening member 472 to penetrate the first side panel 115. That is, the second fastening member 472 may be constructed to penetrate the upper frame 400 and the first side panel 115 together, but a portion of the second fastening member 472 penetrating the first side panel 115 may be surrounded by the fastening insulating portion 474.

The second fastening member 472 penetrated the upper frame 400 may penetrate the second fastening hole 470 and may be inserted into and coupled to the fastening insulating portion 474. The second fastening member 472 may penetrate the upper frame 400 or the first side panel 115 in the longitudinal direction like the screw or the rivet.

The second fastening member 472 may be coupled to the second fastening hole 470 while having a length of penetrating the first side panel 115 together with the upper frame 400 by the fastening insulating portion 474, so that the coupling force may be improved. Because the second fastening member 472 is eventually inserted into and coupled to the fastening insulating portion 474 of the second fastening hole 470, the insulation between the first side panel 115 and the second fastening member 472 may be achieved. Accordingly, the upper frame 400 that may be electrically connected to the second fastening member 472 may be insulated from the first side panel 115.

The fastening insulating portion 474 may be formed in a shape in which an extended end thereof is sealed to receive the second fastening member 472 in the fastening insulating portion 474, or in a shape in which the extended end is opened and an end of the second fastening member 472 is exposed to the outside of the fastening insulating portion 474.

The fastening insulating portion 474 may be constructed to surround at least a portion of the second fastening member 472 that is positioned parallel to the first side panel 115 to receive at least a portion of the second fastening member 472 therein, and may insulate the first side panel 115 and the second fastening member 472 from each other. The first fastening member 462 and the second fastening member 472 may be separated apart from each other to be electrically separated from each other.

In one example, in an embodiment of the present disclosure, each first side panel 115 may include the front end bending portion 116 at the front end thereof. The fastening insulating portion 474 may penetrate the front end bending portion 116.

Specifically, the front end of each first side panel 115 may be located adjacent to the first front panel 112, and the front end bending portion 116 of each first side panel 115 may extend in the lateral direction Y from the front end of each first side panel 115.

That is, the front end bending portion 116 of each first side panel 115 may be disposed parallel to the front face of the first front panel 112. The first side panel 115 disposed on one side in the lateral direction Y of the first treating apparatus 10 may include the front end bending portion 116 extending toward the other side in the lateral direction Y, and the first side panel 115 disposed on the other side in the lateral direction Y of the first treating apparatus 10 may include the front end bending portion 116 extending toward said one side in the lateral direction Y.

That is, the front end bending portion 116 of the first side panel 115 may extend from a front end of a side face of the first side panel 115 forming the side face of the first treating apparatus 10 to the interior of the first treating apparatus 10. The front end bending portion 116 may be formed by being bent or curved at the side face of the first side panel 115.

The front end bending portion 116 may have a face parallel to the first front panel 112, and the first fastening member 462 and the second fastening hole 470 may have lengths in the front and rear direction X and may penetrate the front end bending portion 116 along the front and rear direction X.

The insulating connection member 450 and the upper frame 400 may be located in front of the front end bending portion 116 of the first side panel 115, and the fastening insulating portion 474 may extend rearwardly from the second fastening hole 470 to penetrate the front end bending portion 116.

That is, as shown in FIG. 19, in an embodiment of the present disclosure, the second fastening member 472 may penetrate the upper frame 400, the second fastening hole 470, and the front end bending portion 116 of the second side panel 125 in order. At least the portion of the second fastening member 472 may be inserted into the fastening insulating portion 474 of the second fastening hole 470 and may be coupled to the second fastening hole 470.

The second fastening hole 470 has the fastening insulating portion 474 penetrating the second side panel 125, so that the coupling force between the insulating connection member 450 and the first side panel 115 may be strengthened, and the coupling force between the second fastening member 472 and the second fastening hole 470 may also be strengthened, thereby improving the structural stability.

In one example, as shown in FIG. 17, in an embodiment of the present disclosure, the second front panel 122 may further include an upper end fastening portion 124. The upper end fastening portion 124 may be penetrated together with the upper frame 400 by the second fastening member 472 to be fastened to the second fastening hole 470. FIG. 19 shows a coupling structure from which the upper end fastening portion 124 is omitted.

Referring to FIG. 17, the upper end fastening portion 124 may be disposed above the second front panel 122, and the upper end fastening portion 124 may be disposed on the upper end bending portion 123 of the second front panel 122. That is, the upper end fastening portion 124 may have a shape extending upward from a rear end of the upper end bending portion 123 extending rearward from the upper end of the second front panel 122.

The upper end fastening portion 124 may be overlapped with the upper frame 400 and the insulating connection member 450 in the front and rear direction X, and the second fastening member 472 may penetrate the upper end fastening portion 124 of the second front panel 122, the upper frame 400, the insulating connection member 450, and the first side panel 115 in order and be coupled to the second fastening hole 470 of the insulating connection member 450. In one example, the upper end fastening portion 124 may be electrically connected to the second fastening member 472 and the upper frame 400.

Because the second front panel 122 forms a coupling relationship with each first side panel 115 by the upper end fastening portion 124, the fixing force of the second front panel 122 is improved, and at the same time, the fastening structure between the first treating apparatus 10 and the second treating apparatus 20 is also reinforced, which are advantageous.

In one example, as shown in FIG. 17, in an embodiment of the present disclosure, the lower frame 300 of the first treating apparatus 10 is coupled to each first side panel 115 together with the upper frame 400. Portions of the lower frame 300 and the upper frame 400 connected to each first side panel 115 may be spaced apart from each other, so that the lower frame 300 and the upper frame 400 may be electrically separated from each other.

For example, a position of the portion of the upper frame 400 coupled to the first side panel 115, that is, the insulating connection member 450 is located below a position of the portion of the lower frame 300 coupled to the first side panel 115, so that the upper frame 400 may be spaced apart from the lower frame 300.

Accordingly, at the same time when the coupling between the lower frame 300 and the first side panel 115 is achieved, the coupling between the upper frame 400 and the first side panel 115 is achieved. In addition, the upper frame 400 is coupled to the first side panel 115 through the insulating connection member 450 and is spaced apart from and electrically separated from the lower frame 300. Thus, not only the structural stability of each of the first treating apparatus 10 and the second treating apparatus 20, but also the fastening force between the first treating apparatus 10 and the second treating apparatus 20 is effectively improved, so that the electrical insulation therebetween may be effectively achieved.

Figure 20:
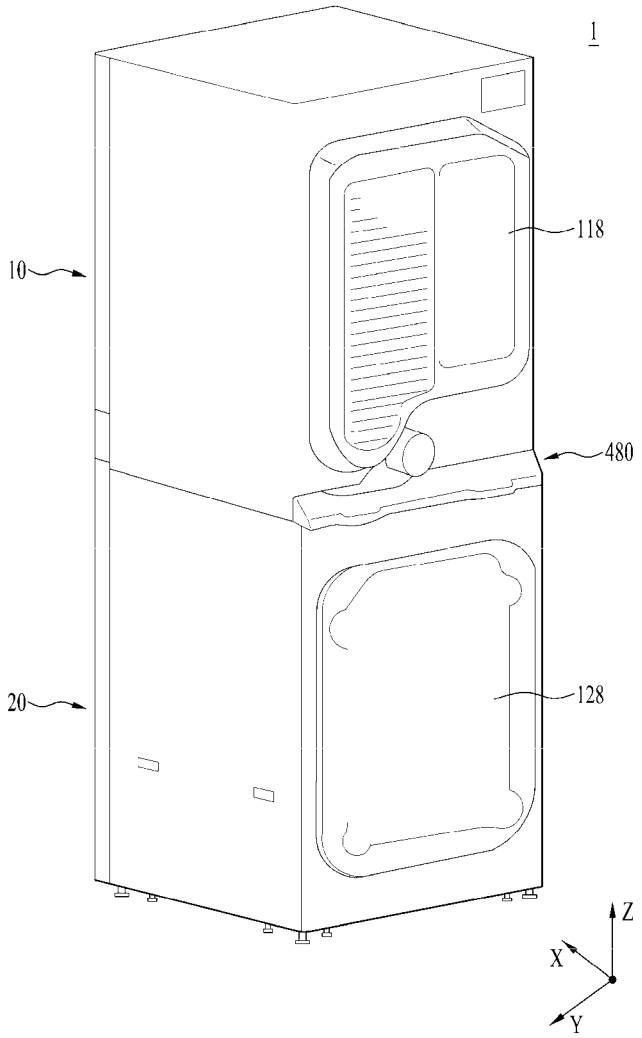
FIG. 20 is a perspective view of a laundry treating apparatus according to an embodiment of the present disclosure viewed from the rear.
Figure 21:
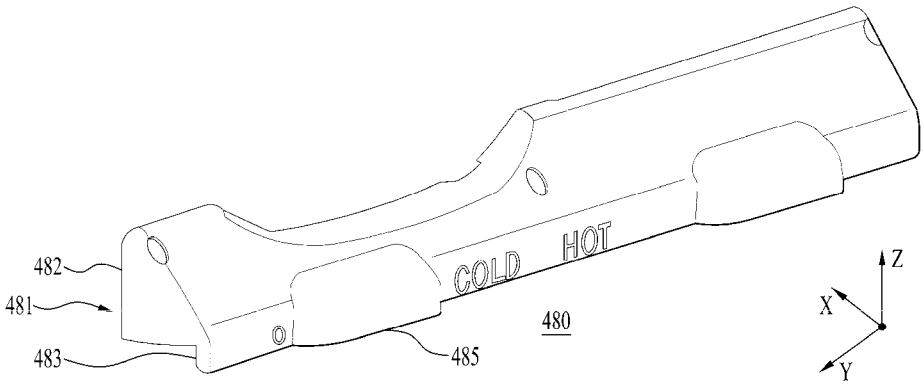
FIG. 21 is a view showing a rear bracket of a laundry treating apparatus according to an embodiment of the present disclosure.

In one example, FIG. 20 shows a view of the laundry treating apparatus 1 according to an embodiment of the present disclosure viewed from the rear, and FIG. 21 shows a rear bracket 480 connecting the first treating apparatus 10 and the second treating apparatus 20 with each other at the rear.

As shown in FIGS. 20 and 21, in an embodiment of the present disclosure, the first treating apparatus 10 may have the first rear panel 118 disposed on the rear face thereof, and the second treating apparatus 20 may have the second rear panel 128 disposed on the rear face thereof. In addition, the rear bracket 480 made of an insulating material and fastening the first rear panel 118 and the second rear panel 128 with each other may be further included.

As described above, the first treating apparatus 10 and the second treating apparatus 20 may be electrically insulated from each other and coupled to each other by the insulating connection member 450 and the upper frame 400 at the front side. Further, the first treating apparatus 10 and the second treating apparatus 20 may be electrically insulated from each other and be coupled to each other through the rear bracket 480 at the rear side.

The first treating apparatus 10 and the second treating apparatus 20 are manufactured separately from each other, and then stacked together and installed to be used together. Therefore, in order to secure the structural stability of the laundry treating apparatus 1 according to an embodiment of the present disclosure, structural fastening between the first treating apparatus 10 and the second treating apparatus 20 stacked together may be required.

Further, as described above, the first treating apparatus 10 and the second treating apparatus 20 respectively include electricity consuming devices independent of each other, such as the components like the motors, the controllers, or the like, so that it may be advantageous that the first treating apparatus 10 and the second treating apparatus 20 are electrically insulated from each other.

Accordingly, in an embodiment of the present disclosure, the first treating apparatus 10 and the second treating apparatus 20 may be fastened to each other through the upper frame 400 and the insulating connection member 450 at the front face of the first treating apparatus 10 and the second treating apparatus 20 stacked together, and may be fastened to each other through the rear bracket 480 at the rear side.

The rear bracket 480 may be made of the insulating material. For example, the rear bracket 480 may be made of the insulating material, such as a plastic material, a rubber material, or a synthetic material of the plastic and the rubber.

The rear bracket 480 may have a length parallel to the lateral direction Y, and may have a length corresponding to a width in the lateral direction Y of the first treating apparatus 10 or the second treating apparatus 20. The rear bracket 480 may be coupled with the first rear panel 118 of the first treating apparatus 10 and the second rear panel 128 of the second treating apparatus 20 together to fasten the first rear panel 118 and the second rear panel 128 with each other.

There may be various coupling schemes between the rear bracket 480, the first rear panel 118, and the second rear panel 128. For example, the rear bracket 480 may be coupled to the first rear panel 118 and the second rear panel 128 together through screws, rivets, or the like, or the hook coupling or the fitting coupling scheme may be used.

Figure 22:
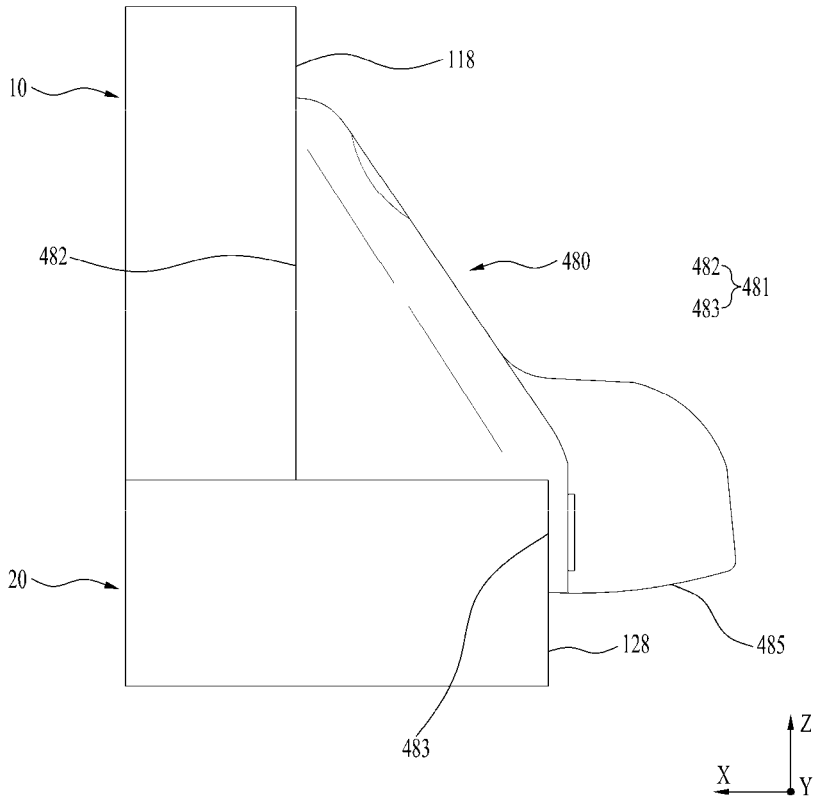
FIG. 22 is a side view showing a rear bracket in a laundry treating apparatus according to an embodiment of the present disclosure.

In one example, FIG. 22 is a cross-sectional view of the rear bracket 480 coupled to the first rear panel 118 and the second rear panel 128 viewed from the side.

Referring to FIG. 22, the rear bracket 480 may fasten the first rear panel 118 and the second rear panel 128 with each other as an upper portion of the rear bracket 480 is coupled to the first rear panel 118 and a lower portion of the rear bracket 480 is coupled to the second rear panel 128.

In this connection, a front face 481 facing forward of the rear bracket 480 may have an upper end 482 in contact with the first rear panel 118, and a lower end 483 in contact with the second rear panel 128. That is, in the rear bracket 480, the upper end 482 of the front face 481 may support the first rear panel 118 from the rear, and the lower end 483 of the front face 481 may support the second rear panel 128 from the rear.

In one example, as shown in FIG. 22, in an embodiment of the present disclosure, the first rear panel 118 may be located forward of the second rear panel 128, and the front face 481 of the rear bracket 480 may be formed in a stepped manner such that the upper end 482 supporting the first rear panel 118 is located forward of the lower end 483 supporting the second rear panel 128.

In an embodiment of the present disclosure, the first rear panel 118 and the second rear panel 128 may be arranged to be spaced apart from each other in the front and rear direction X. For example, the first rear panel 118 may be located forward or rearward of the second rear panel 128. A positional relationship of the first rear panel 118 to the second rear panel 128 may be determined from a design difference between the first treating apparatus 10 and the second treating apparatus 20.

For example, when a length in the front and rear direction X of the first treating apparatus 10 is larger than that of the second treating apparatus 20, the first rear panel 118 may be located rearward of the second rear panel 128. When the length in the front and rear direction X of the first treating apparatus 10 is smaller than that of the second treating apparatus 20, the first rear panel 118 may be located forward of the second rear panel 128.

Alternatively, for an assembly advantage for stacking the first treating apparatus 10 on the second treating apparatus 20, the first rear panel 118 may be positioned in front of the second rear panel 128. For example, in the process of assembling the laundry treating apparatus 1 according to an embodiment of the present disclosure, when the second treating apparatus 20 is placed in an installation region and then the first treating apparatus 10 is lifted on the second treating apparatus 20, the first treating apparatus 10 may slide rearward from a position in front of the second treating apparatus 20 and may be disposed on the second treating apparatus 20.

In this process, the rear bracket 480 may be installed in advance on the second rear panel 128 of the second treating apparatus 20, and the first treating apparatus 10 may be disposed at an appropriate assembly position while a distance of sliding rearward is limited by the rear bracket 480.

In an embodiment of the present disclosure, the length in the front and rear direction X of the first treating apparatus 10 may be smaller than that of the second treating apparatus 20, or at least the lower portion of the first rear panel 118 may be located forward of the second rear panel 128 such that a stopper role of the rear bracket 480 may be achieved.

The front face 481 of the rear bracket 480 may have the stepped shape as shown in FIG. 22 such that the upper end 482 of the front face 481 that forwardly supports the lower portion of the first rear panel 118 is located forward of the lower end 483 that forwardly supports the upper portion of the second rear panel 128.

When the lower portion of the first rear panel 118 is located rearward of the second rear panel 128, the front face 481 of the rear bracket 480 may have the stepped shape such that the upper end 482 is positioned rearward of the lower end 483.

As the front face 481 of the rear bracket 480 has the stepped shape as above, the rear bracket 480 may be coupled to the first rear panel 118 and the second rear panel 128 and fasten the first rear panel 118 and the second rear panel 128 with each other while allowing a positional difference between the first rear panel 118 and the second rear panel 128, and a support structure for supporting the first rear panel 118 of the first treating apparatus 10 located on the second treating apparatus 20 from the rear may be stably realized.

In one example, referring to FIGS. 21 and 22, the laundry treating apparatus 1 according to an embodiment of the present disclosure may have a handle 485 on the rear bracket 480. Specifically, the handle 485 opened downward may be disposed on the lower portion of the rear bracket 480.

The handle 485 may have a shape of a groove that is open downward and recessed upward. The groove of the handle 485 may be defined such that the user may easily grip the handle 485 by putting a finger into the groove.

There may be various positions and shapes of the handle 485, and FIGS. 21 and 22 show the handle 485 that forms a portion of the lower portion of the rear bracket 480 and is opened downward to be gripped by the user, according to an embodiment of the present disclosure.

Figure 23:
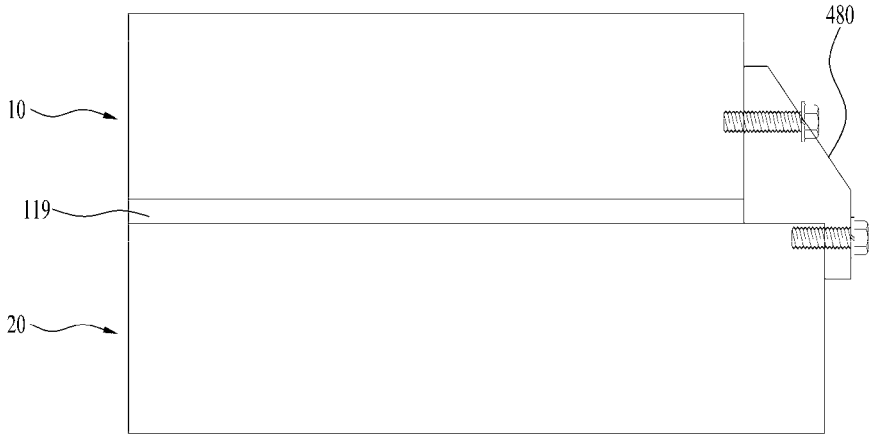
FIG. 23 is a view showing a first bottom panel of a first treating apparatus in a laundry treating apparatus according to an embodiment of the present disclosure.

In one example, FIG. 23 shows the first bottom panel 119 of the first treating apparatus 10 according to an embodiment of the present disclosure. Referring to FIG. 1, in an embodiment of the present disclosure, the first treating apparatus 10 may further include the first bottom panel 119 made of an insulating material.

The first bottom panel 119 may be disposed on the bottom face of the first treating apparatus 10, supported by the second treating apparatus 20, and may be made of the insulating material to be insulated from the second treating apparatus 20.

In the first treating apparatus 10, the first bottom panel 119 may be located on the second treating apparatus 20, and the second treating apparatus 20 may upwardly support the first bottom panel 119 of the first treating apparatus 10. That is, the first bottom panel 119 may be in contact with the top face of the second treating apparatus 20.

In one example, the first bottom panel 119 may be made of the insulating material. For example, the first bottom panel 119 may be made of a plastic material, a rubber material, or a synthetic material of the plastic, the rubber, and the like.

As the first bottom panel 119 in contact with and supported by the second treating apparatus 20 is made of the insulating material, the first treating apparatus 10 may be electrically insulated from the second treating apparatus 20.

That is, as described above, in an embodiment of the present disclosure, the front faces of the first treating apparatus 10 and the second treating apparatus 20 may be fastened to each other in a state electrically insulated from each other by the upper frame 400, the insulating connection member 450, and the like, and the rear faces of the first treating apparatus 10 and the second treating apparatus 20 may be fastened to each other in a state electrically insulated from each other by the rear bracket 480. Furthermore, the first bottom panel 119 of the first treating apparatus 10 may be made of the insulating material and supported on the second treating apparatus 20, so that the first treating apparatus 10 and the second treating apparatus 20 may be electrically separated from each other and may be stably fastened to each other.

In the second treating apparatus 20, the second top panel may upwardly support the first bottom panel 119 of the first treating apparatus 10, or the second side panel 125 may upwardly support the first bottom panel 119.

Figure 24:
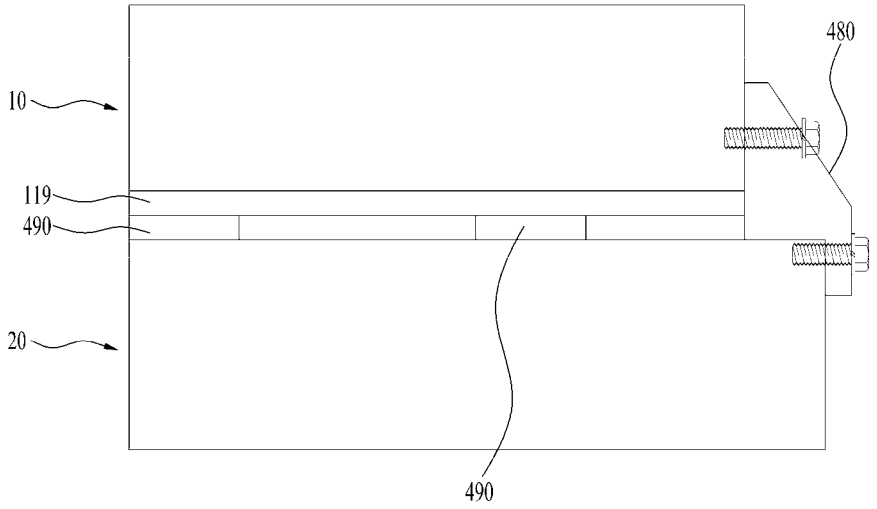
FIG. 24 is a view showing an insulating support in a laundry treating apparatus according to an embodiment of the present disclosure.

In one example, FIG. 24 shows a state in which an insulating support 490 is disposed between the bottom face of the first treating apparatus 10 and the top face of the second treating apparatus 20.

Referring to FIG. 24, in an embodiment of the present disclosure, the insulating support 490 that supports the bottom face of the first treating apparatus 10 from the top face of the second treating apparatus 20, and is made of an insulating material to insulate the first treating apparatus 10 and the first treating apparatus 10 from each other may be further included.

The insulating support 490 may protrude downward from the bottom face of the first treating apparatus 10, may protrude upward from the top face of the second treating apparatus 20, or may be manufactured separately from the first treating apparatus 10 and the second treating apparatus 20 and disposed between the first treating apparatus 10 and the second treating apparatus 20.

The insulating support 490 may be disposed beneath the first bottom panel 119 or the first side panel 115 of the first treating apparatus 10, and the insulating support 490 may be disposed in a state in which the first bottom panel 119 of the first treating apparatus 10 is omitted.

In addition, the insulating support 490 may be disposed on a front face of the second top panel or the second side panel 125 of the second treating apparatus 20, or may have a structure in which the second top panel of the second treating apparatus 20 is omitted.

In addition, the insulating support 490 may be disposed on a lower end of the first bottom panel 119 or the first side panel 115 of the first treating apparatus 10, and the second top panel may be omitted in the second treating apparatus 20, so that the insulating support 490 may be supported upward by the second side panel 125 of the second treating apparatus 20.

The insulating support 490 may be formed in various shapes, and may be made of plastic or rubber, or a synthetic material of the plastic, the rubber, and the like.

As the first treating apparatus 10 is supported upward on the second treating apparatus 20 by the insulating support 490, in an embodiment of the present disclosure, the stable structure in which the first treating apparatus 10 and the second treating apparatus 20 are stacked together but are electrically insulated from each other may be realized.

Although the present disclosure has been illustrated and described in relation to a specific embodiment, it is understood that the present disclosure may be variously improved and changed within the scope of the technical idea of the present disclosure provided by the following claims. It will be obvious to those of ordinary skill in the industry.

What is claimed is:

1. A stacked laundry treating system comprising:

a first treating apparatus including:

a first cabinet that includes (i) first side panels that define lateral side faces of the first treating apparatus, respectively, and (ii) a first rear panel that defines a rear face of the first treating apparatus, a first front panel that is disposed at a front side of the first cabinet, that defines a front face of the first treating apparatus, and that has a first laundry inlet, and a first drum that is disposed inside the first cabinet and that is in fluid communication with the first laundry inlet;

a second treating apparatus that is disposed below the first treating apparatus and that supports the first treating apparatus, the second treating apparatus including:

a second cabinet that includes (i) second side panels that define lateral side faces of the second treating apparatus, respectively, and (ii) a second rear panel that defines a rear face of the second treating apparatus, a second front panel that is disposed at a front side of the second cabinet, that defines a front face of the second treating apparatus, and that has a second laundry inlet, and a second drum that is disposed inside the second cabinet and that is in fluid communication with the second laundry inlet; and a control panel, wherein the second front panel extends upwardly above a top of the second cabinet and is disposed at and coupled to a lower part of the front side of the first cabinet, the second front panel including an upper end bending portion that is bent rearward from an upper end of the front face of the second treating apparatus, wherein the second treating apparatus further comprises an upper frame that is disposed between the second front panel and the second cabinet, that is coupled to the front side of the second cabinet, and that extends upwardly above the top of the second cabinet, the upper frame being disposed rearward relative to the upper end bending portion, and wherein the control panel is configured to be disposed between the first front panel and the second front panel based on the second front panel and the upper frame being coupled together to the front side of the first cabinet.

2. The stacked laundry treating system of claim 1, wherein the upper frame extends upward and is disposed behind the upper end bending portion.

3. The stacked laundry treating system of claim 2, wherein the second front panel further comprises an upper end fastening portion that extends upward from a rear end of the upper end bending portion and that is coupled to the lower part of the front side of the first cabinet with the upper frame.

4. The stacked laundry treating system of claim 3, wherein the first side panels include a first front end bending portion that is bent in an inside width direction from a front end of one of the lateral side faces of the first treating apparatus, and wherein the upper end fastening portion and the upper frame are coupled to the first front end bending portion.

5. The stacked laundry treating system of claim 1, wherein the upper frame includes:

a lower part coupled to the second side panels; and an upper part coupled to the first side panels.

6. The stacked laundry treating system of claim 5, wherein the second side panels include a second front end bending portion that is bent in an inside width direction from a front end of one of the lateral side faces of the second treating apparatus, and wherein the lower part of the upper frame is coupled to the second front end bending portion.

7. The stacked laundry treating system of claim 6, wherein the second front panel further includes a side end bending portion that is bent rearward from a side end of the front face of the second treating apparatus, and wherein the upper frame is disposed between the side end bending portion and the second front end bending portion.

8. The stacked laundry treating system of claim 5, further comprising:

an insulating connection member that is made of an insulating material and that is disposed at the lower part of the front side of the first cabinet, and wherein the upper part of the upper frame is coupled to the insulating connection member.

9. The stacked laundry treating system of claim 8, wherein the insulating connection member includes:

a first fastening member coupled to one of the first side panels; and a second fastening member coupled to the upper part of the upper frame.

10. The stacked laundry treating system of claim 9, wherein the insulating connection member includes:

a fastening insulating portion that penetrates the first side panel and that defines a hollow; and a fastening member that penetrates the upper frame and that is inserted into the hollow.

11. The stacked laundry treating system of claim 1, wherein a lower end of the first front panel is located above a lower end of the first cabinet, and wherein the first treating apparatus further includes a lower frame that is disposed below the first front panel and that divides an interior of the stacked laundry treating system from an outside of the first treating apparatus.

12. The stacked laundry treating system of claim 11, wherein the lower frame includes a main frame face that extends along a lateral direction and that defines a connection hole, and wherein the stacked laundry treating system further comprises a signal connection line that passes through the connection hole and that extends from the interior of the stacked laundry treating system to the control panel.

13. The stacked laundry treating system of claim 12, wherein the signal connection line includes a connection port connected to the control panel.

14. The stacked laundry treating system of claim 11, wherein the control panel is disposed at a front of the lower frame and the upper frame and covers the lower frame and the upper frame from a front outside of the control panel.

15. The stacked laundry treating system of claim 11, wherein the upper frame is spaced apart from the lower frame.

16. The stacked laundry treating system of claim 1, wherein the upper frame defines a detergent storage receiving opening, and wherein the second treating apparatus further comprises a detergent storage that penetrates the detergent storage receiving opening.

17. The stacked laundry treating system of claim 16, wherein the second front panel defines an opening at a position corresponding to the detergent storage receiving opening.

18. The stacked laundry treating system of claim 17, wherein the detergent storage receiving opening and the opening of the second front panel are disposed below the control panel.

* * * * *